US005827119A

United States Patent [19]

Bromley

[11] Patent Number: 5,827,119

[45] Date of Patent: Oct. 27, 1998

[54] ROTATABLE PLAYING SURFACE GAME

[75] Inventor: Lauran Bromley, Northbrook, Ill.

[73] Assignee: Bromley Incorporated, Northbrook, Ill.

[21] Appl. No.: 689,783

[22] Filed: Aug. 14, 1996

[51] Int. Cl.[6] ..... A63F 9/22

[52] U.S. Cl. ..... 463/7; 463/17; 273/142 B; 273/142 F

[58] Field of Search ..... 463/7, 17, 16; 273/142 R, 142 E, 142 F, 142 B, 138.2

[56] References Cited

U.S. PATENT DOCUMENTS

| | | | |
|---|---|---|---|
| 3,853,324 | 12/1974 | Reiner et al. | 273/142 F X |
| 3,877,700 | 4/1975 | Moe | 273/142 F X |
| 4,036,497 | 7/1977 | Garto et al. | 273/101 |
| 4,077,631 | 3/1978 | Tela | 273/142 |
| 4,601,470 | 7/1986 | Kadota et al. | 273/142 E |
| 4,643,425 | 2/1987 | Herzenberger | 463/17 |
| 4,732,385 | 3/1988 | Castellanos | 273/142 B |
| 4,735,416 | 4/1988 | McNally | 273/142 B X |
| 4,852,885 | 8/1989 | Baratpour et al. . | |
| 5,259,616 | 11/1993 | Bergmann | 273/138 A |
| 5,263,715 | 11/1993 | Matsumoto et al. . | |
| 5,472,197 | 12/1995 | Gwiasda et al. | 273/143 R |

FOREIGN PATENT DOCUMENTS

| | | | |
|---|---|---|---|
| 8204804 | 7/1984 | Netherlands | 273/142 F |

*Primary Examiner*—Jessica Harrison
*Assistant Examiner*—Michael O'Neill
*Attorney, Agent, or Firm*—Breneman & Georges

[57] ABSTRACT

A rotatable playing surface amusement game which is automatically controlled by a microprocessor which includes a rotatable object and a segmented substantially circular rotatable playing surface surrounded by a race and means for accelerating the rotatable object onto a race with sufficient centrifugal force as to maintain the rotatable object in the race for a predetermined period of time which upon a timed or player input results in the stopping of the substantially circular rotating playing surface alone or together with the race which may also be rotatable while the rotatable object continues to rotate in the race held by centrifugal force until gravity and inertia result in the return of the rotatable object back onto the rotatable playing surface and coming to rest on a particular segment. The rotatable surface game includes a housing, transparent cover, player control input panels and contact sensors for indicating the resting position of the rotatable object controlled by a microprocessor which awards rewards based upon player input selection of the projected final position of the rotatable object. The rotatable playing surface may be segmented equally or unequally and the segments may contain various segment identifying indicia along with timing switches and player controlled skill switches to test judgment of speeds, inertia and movement of the rotatable object with respect to the various segments of the rotatable playing surface.

48 Claims, 17 Drawing Sheets

FIG.8
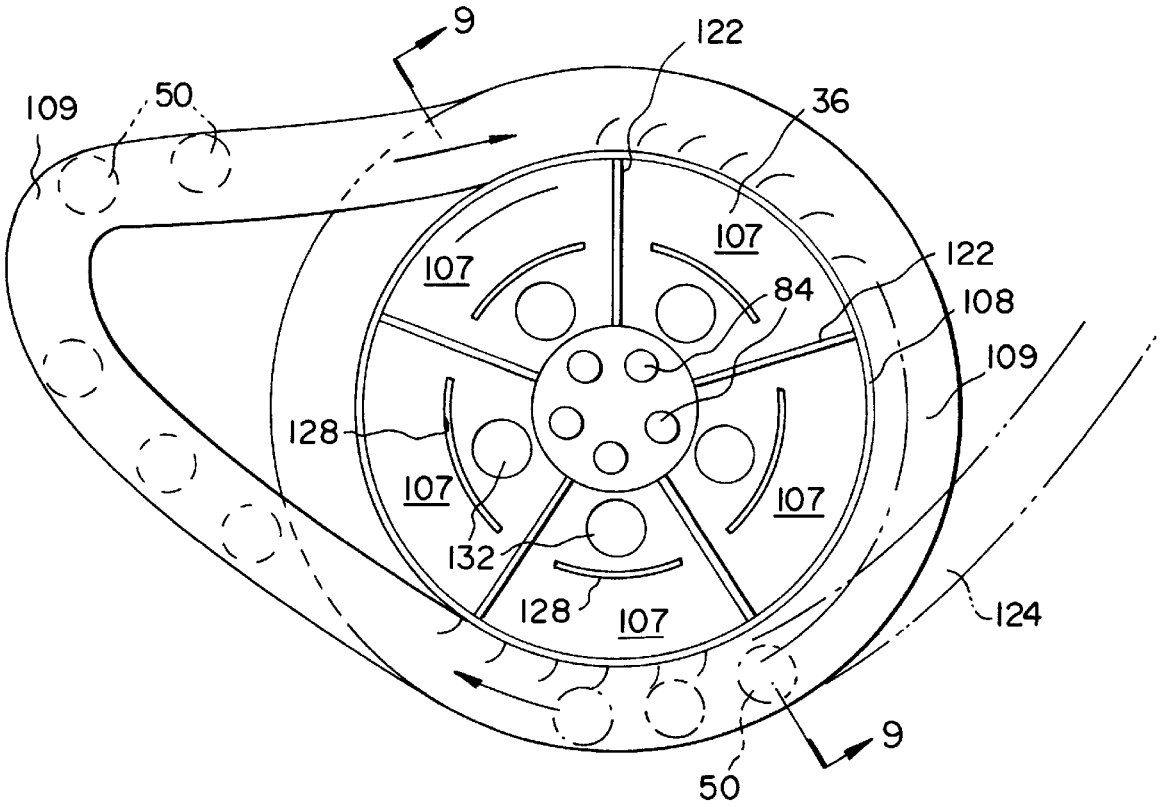
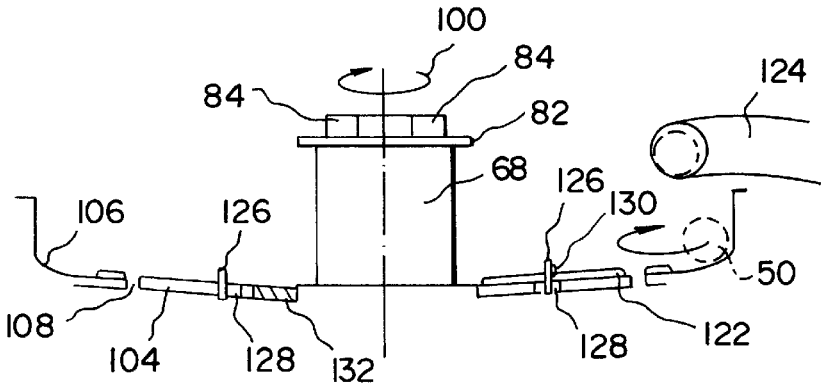
FIG. 9

TICKET DISPENSERS
LOW TICKET LIGHTS
TICKET LOW SWITCH
TICK. 1
TICK. 2
TICK. 3
TICK. 4
TO FIG. 12B
DISPLAY
METERS
TICKET
COIN
J8 J6 7
J4 CPU 5
J1 J2 3
J4 J3
J9 J8 J7
I/O BOARD
J1
J2
FLUORESCENT LAMP
MARQUEE WINNER LAMPS
TO FIG. 12B

ROTATABLE PLAYING SURFACE GAME

BACKGROUND OF THE INVENTION

1. Field of the Invention

The present invention pertains to an amusement game having one or more rotatable playing surfaces and a race circumscribing the one or more rotatable playing surfaces along with a rotatable object and mechanical means for accelerating the rotation of the rotatable object into the race. The rotatable playing surface is segmented into one or more equal or unequal segments having identifying indicia upon which the rotatable object will come to rest once the rotation of the rotatable playing surface is stopped and the rotatable object has stopped rotating and come to rest.

More particularly, the rotatable playing surface game of the invention is a microprocessor-controlled amusement game which accommodates one or more player inputs based upon their estimated projection of the final resting position of the rotatable object after it has been accelerated from the rotatable playing surface onto a race surrounding the rotatable playing surface. As soon as the rotatable object is accelerated onto the race, the rotation of the rotatable playing surface can be stopped and the rotatable object which is preferably spherical and continues to rotate in the race circumscribing the rotatable playing surface until the inertia and centrifugal forces are no longer sufficient to maintain the rotatable object in the circular race and the rotatable object rolls onto the circular rotatable playing surface and comes to rest in one of the segments of the circular rotatable playing surface. The particular segment upon which the rotatable object stops is automatically determined by a sensor which determines the resting position of the rotatable object on the playing surface and transmits the information to the microprocessor which compares the player inputs at the beginning of the game with the final position of the rotatable object and provides rewards or other incentives.

The novel rotatable playing surface game includes a rotatable playing surface with means for accelerating the free wheeling rotatable object into a substantially circular race circumscribing the rotatable playing surface. Once the rotatable object is rotating within the circular race, the rotatable playing surface is stopped which may also stop the circular race surrounding the rotatable playing surface in embodiments where the circular race is connected to the rotatable playing surface. The rotatable object then continues by its own inertia to rotate around the circular race until the inertia of the rotatable object approaches zero at which time it comes to rest in one of the segments dividing the substantially circular rotatable surface.

The rotatable playing surface in the meantime has been stopped which can be achieved by pulsing the motor means for a few microseconds in a reverse direction to provide an immediate stop of the rotating playing surface. The stopping of the rotatable playing surface before the rotatable object leaves the circular race distinguishes the invention from prior art roulette games, in which the rotatable playing surface is spun in a direction opposite to the direction of rotation in the race of the marble, ivory or metal ball used in roulette games.

The rotatable playing surface game of the invention is further distinguishable from prior art roulette games which utilize an equally segmented rotatable playing surface. The rotatable playing surface of the invention in contrast is segmented either equally or unequally and is surrounded by a circular race which may be part of the playing surface or be a separate component which may be fixed or separately rotatable with respect to the rotatable playing surface.

The rotatable playing surface game of the invention further unlike prior art roulette wheels is fully automatic and computer-controlled and includes a center tower including sensors which detect the position of the rotatable object on the rotatable playing surface once the rotatable playing surface has stopped and a time limit has expired for the rotatable spherical object to travel in the race surrounding the rotatable playing surface. The segmented rotatable playing surface may also include sensors in holes disposed in the segments so that the rotatable object is removed from the playing surface at the end of the game and is removed from the rotatable playing surface before again being accelerated and deposited upon the circular race by a separate chute designed to deposit the rotatable object upon the circular race.

The race circumscribing the rotatable playing surface may itself be rotatable, stationary or be part of the rotatable playing surface. The race may also be of a configuration that is other than circular. Where the race is part of the rotatable playing surface the race may be formed by utilizing an upturned outer edge around the rotatable playing surface which can form a circular race in which the rotatable object is free to freely rotate after acceleration from the rotatable playing surface into the race by centrifugal forces.

The mechanical means for accelerating the rotatable object onto the race can include a variety of mechanical means including ribs disposed on the rotatable playing surface, a mechanical acceleration arm disposed above the rotatable playing surface or a combination of holes in the rotatable playing surface connected to an object acceleration chute for depositing the rotatable object in the race surrounding the rotatable playing surface.

The rotatable playing surface game is disposed in a housing having a transparent cover for viewing the rotatable playing surface and the rotatable object in the race circumscribing the rotatable playing surface. The race surrounding the rotatable playing surface may be fixed or may itself be rotatable once the rotating playing surface has stopped. The race surrounding the rotatable playing surface may be itself rotated in a direction clockwise or counterclockwise with respect to the stopped rotatable playing surface. The rotation of the rotatable playing surface as well as the rotatable race circumscribing the rotatable playing surface may be connected to controls associated with the player input panel by which the player can, within a particular segment of time, stop the rotation of the rotatable playing surface or the rotatable race surrounding the rotatable playing surface.

The novel rotatable playing surface game is designed to teach and test skills of relative motion involving a free wheeling rotatable object in a race associated with a stationary segmented playing surface to test and sharpen skill of relative speed and motion of one player or multiple players. These skills involve judgment of relative motion, velocities and spacial arrangements with respect to a particular segment requiring skill of the player to stop the rotatable surface within a particular time interval in order to anticipate the path and final destination of a rotatable object as the inertial forces on the free wheeling object are diminished to zero.

2. Description of Related Prior Art

The prior art includes many different roulette and roulette-type games and devices that have been in use for many years. The typical prior art roulette wheel includes a rotatable wheel and a rotatable spherical object which requires a game table, players and an attendant who rotates the roulette wheel in a clockwise or counterclockwise direction and then forces the roulette ball to travel in an opposite direction in a fixed circular race surrounding the roulette wheel. In the prior art roulette table the wheel continues to spin while the roulette ball continues to travel in the circular path until gravity pulls the roulette ball down onto the spinning roulette playing surface causing the ball to jump over one or more equally distributed pockets around the circumference of the roulette table.

As will be recognized by those skilled in the art the jumping of the ball over the pockets results not only from the slowing of the inertia of the roulette ball but also the opposite direction of rotation of the roulette wheel.

Prior art roulette games, unlike the present invention, are games primarily of chance involving very little skill since whatever skill is exercised it is exercised by the attendant through inputs of rotational forces on the wheel as well as the roulette ball.

The invention, unlike the roulette wheel of prior art, does not utilize an attendant but instead is completely automatic and enclosed and computer-controlled. Further, unlike the prior art roulette wheel the invention does not utilize a roulette table which spins in one direction while the roulette ball rotates in the opposite direction. In the invention the rotatable playing surface is designed to be stopped after the freewheeling rotatable object has been propelled and deposited onto the circular race surrounding the rotatable playing surface. The invention unlike the prior art utilizes a skill-stop switch which allows the first player activating the skill-stop switch within a particular segment of time to stop the rotation of the rotatable playing surface which is not done in the prior art roulette games. Prior art roulette games also all employ an equally segmented roulette table as well as utilizing a fixed circular race which is fixed in relation to the roulette wheel.

The invention further unlike the prior art roulette wheel provides a player interactive game that continues as the game proceeds. In roulette player involvement stops once a particular segment is selected. In the game of the present invention player involvement not only includes the selection of a segment, which is preferably of unequal area, but continues after the rotatable object is put into play by challenging the player or players to activate skill-stop switches to block other players or to increase their opportunity for successfully matching their segment selection with the segment in which the rotatable object comes to rest. This player involvement and interaction during the game includes a microprocessor and program which is designed to stop the rotation of the rotatable playing surface at a predetermined period of time if the player does not stop the rotation of the rotatable playing surface first.

In accordance with the invention the race and preferably a circular race may be part of the rotatable playing surface so that once the rotatable circular object reaches its maximum velocity in the race rotating with the rotatable playing surface both the rotatable playing surface and the race stop and remain stationary as inertial forces on the free wheeling rotatable object dissipate and result in the rotatable spherical object coming to rest in one of the equally or unequally divided segments of the rotatable playing surface.

The known prior art in addition to the typical gambling roulette tables also includes a number of more modern variations of the roulette game as exemplified by Tela U.S. Pat. No. 4,077,631. In Tela U.S. Pat. No. 4,077,631 a variation of a roulette game is provided having a different layout of groups of numbers on the inside and outside of the roulette wheel. The modern roulette game of U.S. Pat. No. 4,077,631 is not automatic and like the typical prior art roulette games requires an attendant to spin the roulette wheel in one direction and roll the roulette ball in opposite direction to play the roulette game. Further, like the typical prior art roulette games U.S. Pat. No. 4,077,631 does not allow one of the players to stop the rotation of the roulette wheel within a particular time segment while the ball continues rolling around the circular track of the roulette wheel.

An automated roulette gaming apparatus is disclosed in Kadota, et al. U.S. Pat. No. 4,601,470 in which a roulette wheel of a standard appearance is in a housing to provide an automated roulette game that, like the present invention, does not require an attendant. In Kadota, et al. U.S. Pat. No. 4,601,470 the attendant of the typical roulette table is replaced by a roulette gaming apparatus in which a metal roulette ball is automatically thrown onto a stationary ball rotating passageway and the roulette wheel is rotated in the opposite direction. The automated roulette device of Kadota requires the ball to be constructed of a magnetic material since after the metallic ball is flung from one of the pockets onto the rotating passageway the metallic ball is sensed and accelerated by magnets arranged around the perimeter of the passageway so that magnetic forces on the magnetizable metal ball result in the ball obtaining a predetermined maximum velocity in the circular passageway after a predetermined amount of time. After the magnetic ball has obtained its maximum speed the electric power to the electromagnets is turned off as the roulette table rotates in the opposite direction until such time as the ball finally looses inertial force and falls into one of the pockets on the roulette wheel. In contrast to such prior art the invention does not utilize a roulette table or provide a roulette game. The game of the invention is not limited to the use of a ball made out of a magnetizable material in order to accelerate the ball to reach its maximum velocity. The invention unlike the prior art is a game of skill since the player can exercise control over the game by stopping the rotating playing surface within a period of time before the non-metallic spherical object gradually loses inertia and falls back onto the rotating playing surface. The game of the invention in addition employs a table that is segmented either equally or unequally and the circular race can either be rotating, non-rotating or part of the rotatable playing surface.

Other known prior art such as Bergmann U.S. Pat. No. 5,259,616 provides a roulette-type coin operated gaming machine in which a random number generator is utilized to determine the winner. This gaming device like Kadota U.S. Pat. No. 4,601,470 is computer-controlled but unlike the present invention does not utilize skill in the operation of the device. In addition Bergmann U.S. Pat. No. 5,259,616 does not utilize a rotating ball nor are the segments divided unequally nor does Bergmann provide for a rotatable and non-rotatable circular race in conjunction with a rotatable playing surface which players utilizing skill can stop or which stops automatically after a predetermined period of time.

Other known prior art games having a rotatable playing surface include Garto, et al. U.S. Pat. No. 4,036,497 and Baratpour, et al. U.S. Pat. No. 4,852,885. In Garto, et al. U.S. Pat. No. 4,036,497 a rotatable playing surface is provided wherein a rotatable spherical object is dropped from an overhanging basket onto a rotating drum having a plurality of openings for receiving the spherical object dropped from the drum. The Garto, et al. U.S. Pat. No. 4,036,497 game is not fully automatic and is not controlled by computer program nor does it include a rotatable or non-rotatable circular race in association with the rotatable playing surface. Baratpour, et al. U.S. Pat. No. 4,852,885 similarly contains a rotatable playing surface but does not include a rotatable spherical object and is played by starting and stopping a rotatable wheel bearing letters and numbers with a game board requiring players to complete words with the letter on which the rotating playing surface has stopped. These prior art games unlike the game of the invention do not test or teach skills of relative motions of moving and non-moving rotatable playing surfaces with respect to a free wheeling rotatable object.

Other known prior art such as Matsumoto, et al. U.S. Pat. No. 5,263,715 and Gwiasda, et al. U.S. Pat. No. 5,472,197 provide a computerized track ball and computerized slot machine arm switch control respectively. The Matsumoto, et al. U.S. Pat. No. 5,263,715 provides a computer game utilizing a track ball for simulating the throwing of dice. The rolling speed and angle of the dice are derived from the amount and direction of operation of the track ball which is then provided on a display. Gwiasda, et al. U.S. Pat. No. 5,472,197 provides a microprocessor-controlled slot machine for rotating the wheels of a slot machine. Neither these nor the other known prior art previously discussed utilize the rotatable playing surface of the invention which may be segmented equally or unequally and utilize a rotatable playing surface which is surrounded by a circular or non circular race which may or may not be separately rotatable with respect to the rotatable playing surface. Further none of the prior art rotatable playing surface games include a rotatable playing surface having fins designed to accelerate the rotatable object into the circular race and which rotatable playing surface is thereafter designed to stop after a predetermined interval of time which, if not expired, allows the players to exercise skill in determining the time to stop the rotatable playing surface to assist them in judging inertia, distance and likelihood of the rotatable spherical object stopping on a particular preselected segment of the rotatable playing surface.

The known prior art also does not include a rotatable playing surface game which allows the players to select a segment of an unevenly segmented rotatable playing surface upon which the rotatable object will come to rest and then play against each other utilizing skill to stop the rotatable playing surface at a particular position in relation to the rotatable object to better their chance of the rotatable object stopping in their particular preselected segment. The invention provides for computer control to keep track of player selections and provide a time-sequence priority of selections to allow the first player selecting a particular segment to have priority over subsequent players and block inputs from later players.

The rotatable playing surface may be divided equally but with the same identifying indicia for two or more segments so that the chance of hitting one indicia identified segment is higher than another identified segment and thus allow the players to handicap their segments with respect to each other or with respect to a novel rotatable playing surface game when only one player is playing. Unlike the prior art the invention requires and teaches high levels of skill in judging relative inertia and position and tests skills in inertial and spacial problems and relationships.

SUMMARY OF THE INVENTION

The invention pertains to a rotatable playing surface game having a circular rotatable playing surface and a race of a circular or non circular configuration surrounding the rotatable playing surface along with a rotatable object and means for accelerating the rotatable object from the circular rotatable playing surface onto the circular race surrounding the rotatable playing surface along with means for stopping the rotation of the rotatable playing surface after the rotatable object is accelerated onto the race circumscribing the rotatable playing surface but before the inertial forces on the rotatable object result in its return back onto the rotatable playing surface. The rotatable playing surface includes ribs, arms or other means for accelerating the rotatable object into the race circumscribing the rotatable playing surface.

The rotatable surface playing game in its preferred embodiment includes a housing preferably having multiple player positions which is microprocessor-controlled for receiving and storing player inputs and selections of segments of the rotatable playing surface having identifying indicia for the various segments of the rotatable playing surface. The housing for the rotatable playing surface game is preferably five-sided having one side of an unequal length and four equal length sides with four player control panels disposed in the four equal length sides around the rotatable playing surface game housing. The rotatable playing surface game housing includes a transparent cover which covers the rotatable playing surface as well as the race circumscribing the rotatable playing surface.

The rotatable playing surface game includes a display attached to the housing and indicia on the display for identifying each of the segments of the segmented rotatable playing surface. The rotatable playing surface is preferably circular in configuration and is segmented equally or unequally into segments which are preferably defined by ribs which are employed to not only define the individual segments but also to accelerate the rotatable object from a position of rest in one of the segments of the rotatable playing surface onto the race surrounding the rotatable playing surface.

A tower or sensor drum is disposed at the center of the rotatable playing surface for sensing and providing information to the microprocessor as to the position of the rotatable object on the segmented rotatable playing surface. The indicia on the segmented playing surface match buttons on the control panel which are connected to the microprocessor which operates the game and the display. The buttons on the player control panel for selecting each of the indicia of the segmented playing surface are preferably controlled by the microprocessor to provide a time sequence priority to prevent multiple players from selecting the same segment and allowing the first player selecting a particular segment to have priority and prevent other players from selecting the same segment.

The microprocessor-controlled game further includes a coin or token accepting mechanism, a ticket or reward dispenser, lighting and speakers to play attract sounds as well as a levelling indicator means to indicate when the housing is properly levelled. The rotatable playing surface game can further include running lights to track the position of the rotatable object and include sounds and lighting for indicating a particular segment has been successfully selected.

The housing also provides support for motors for rotating the rotatable circular playing surface as well as a prize dispenser for awarding prizes, tickets, coins or other rewards for successfully selecting a particular segment. In the best mode the invention further includes a switch on each player console providing a time sequence priority controlled by the microprocessor to allow the first player to activate the switch or allow the microprocessor to stop the rotation of the circular playing surface prior to the slowing of the rotatable object to a speed that would allow the rotatable object to enter onto the rotatable playing surface.

The rotatable playing surface game may also optionally include switches for receiving player input to start the rotatable surface game by accelerating one or more rotatable objects from the rotatable playing surface onto the circular race circumscribing the rotatable playing surface. Once the rotatable object is accelerated onto the circular race surrounding the rotatable playing surface the game includes a timed delay for stopping the rotatable playing surface prior to the reduction of the centrifugal forces where the rotatable object begins to contact one or more of the segments on the circular playing surface. In addition an optional player-skill switch can be provided to allow the first player to activate the switch to stop the rotation of the circular playing surface prior to the microprocessor automatically stopping the rotation of the rotatable playing surface at a point when the reduction of centrifugal forces on the rotatable object causes the rotatable object to leave the race and enter back onto the circular playing surface. The microprocessor is further associated with sensors which determine the position of the rotatable object at rest and award prizes and tokens, tickets or other rewards for predicting the correct segment upon which the spherical object comes to rest.

The circular playing surface includes in the preferred embodiment a plurality of ribs for accelerating the rotatable object from the rotatable playing surface onto a circular race surrounding the rotatable playing surface. In the best mode of the invention the ribs operate as the acceleration means for accelerating the rotatable object onto the circular race which rotates as part of the rotatable playing surface.

The preferred embodiment of the invention further utilizes an unequally segmented rotatable playing surface which is unequally divided into various color segments, which color segments represents varying degrees of difficulty in having the rotatable object come to rest. In this embodiment of the invention the ribs dividing the rotatable playing surface are of sufficient height and extend outwardly from the center of the playing surface for a sufficient distance to force the rotatable object into the circular race surrounding the circular playing surface. In this embodiment of the invention the circular race surrounding the circular playing surface rotates with the circular playing surface. The circular race surrounding the rotating playing surface in this embodiment is formed by turning the end of the circular playing surface upwardly to form a substantially circular race circumscribing the circular playing surface.

In an alternative embodiment of the invention the race surrounding the rotatable playing surface may be a separate element from the rotatable playing surface and be of a circular or non circular configuration. In such applications the distance between the rotatable playing surface and race is not so wide as to prevent the rotatable spherical object from travelling between the rotatable circular playing surface and the race. In embodiments where the race is separate from the rotatable playing surface the race surrounding a rotatable playing surface may be stationary or be itself rotatable with respect to the rotatable playing surface. In such embodiments the race may rotate in the same direction or in a direction opposite to the rotation of the rotatable playing surface.

In the best mode of the invention the microprocessor allows the rotation of the rotatable playing surface to continue until such time as the player stops the rotation of the rotatable playing surface or until before the rotatable object loses the momentum required to stay in the circular race and before the rotatable object begins to travel toward the rotatable playing surface. At this point in time the rotation of the rotatable playing surface is stopped and the rotatable object enters onto the playing surface and is slowed to a stop by the ribs segmenting the playing surface. Once the rotatable object has stopped the slant of the rotatable playing surface toward the center results in the rotatable object contacting a tower or drum at the center containing sensors which provide information to the microprocessor as to the resting position of the rotatable object.

In the various applications of the invention the rotatable playing surface game may preferably include sensors arranged around a circular tower at the center of the rotatable playing surface. The sensors are designed to identify each of the various segments on the rotatable playing surface. Alternatively the rotatable playing surface may include holes corresponding to each segment in which the rotatable object is allowed to fall into once its inertia has dissipated. In this embodiment of the invention each of the holes can include a sensor for determining the segment in which the rotatable object has landed. In this embodiment a return chute is provided for accelerating the rotatable object back onto the race surrounding the rotatable playing surface.

In other embodiments of the invention the rotatable playing surface may utilize an arm instead of the ribs as the means for accelerating the rotatable object from the rotatable playing surface onto the race surrounding the rotatable playing surface. In this embodiment the arm may be actuated at the beginning of the game to accelerate the rotation of the rotatable object from the rotatable playing surface onto the race and thereafter the arm may be raised to a position on the tower at the center of the rotatable playing surface where it would not interfere with the game once the rotatable spherical object has entered into the race surrounding the rotatable circular playing surface.

In the best mode of the invention the rotatable playing surface and circular race surrounding the rotatable playing surface are integral to form a drum which is unequally segmented. The identifying indicia for each of the five unequal segments is five different colors. As heretofore discussed the segmentation may be equal or unequal and the segments may be identified by identifying indicia other than colors. In the best mode of the invention the colors utilized are red, yellow, blue, green and white. These colors are divided into five unequal segments by seven ribs on the rotatable playing surface in which red and green each occupy approximately thirty percent of the playing surface, yellow and blue each occupy approximately fifteen percent of the playing surface and white occupies the remaining percentage of the playing surface. The unequal segmentation of the rotating playing surface makes the game more interesting when played by a single player since the difficulty of hitting a white segment or a yellow or blue segment is sufficiently greater than hitting a green or red segment. Consequently the rewards provided for properly judging the inertial and spacial relationships between the white and blue and yellow segments result in an increased reward. This arrangement also makes the game interesting for multiple players when combined with the software and microprocessor of the invention which time sequences multiple player selection and allows the first player selecting priority over later selecting players.

The microprocessor controls the operation of the game by storing selected player inputs and selected playing surface segments before the start of the game and before starting the rotation of the rotatable playing surface. The microprocessor also operates the attract lights and sounds between games and controls the operation of the display and various timed and delay switches that may have a player override as well as time priority sequence switches that allow player game selection and game commands to be executed only by the first player that accesses the switch during a particular time interval thereby forcing later players to select among segments of an unequally segmented playing surface that occupy a smaller percentage of the rotatable playing surface. The microprocessor also receives and executes the software based control of the rotatable playing surface game and receives input from sensors as to the resting position of the rotatable object and awards prizes based upon a comparison of preselected inputs and final sensor outputs. The microprocessor can also provide for the activation of LED light displays and speakers for providing visual and audible means for signalling the successful selection of a particular segment of the rotatable playing surface by one of a plurality of players.

The housing of the novel rotatable playing surface game in the preferred application of the invention includes a plurality of player control panels surrounding the novel rotatable playing surface game so that a number of players can simultaneously test their skills against each other and the novel rotatable playing surface game. The microprocessor is designed to keep track of one or multiple player inputs and provide a time priority selection so that the selection of a particular segment by one player is blocked if a previous player has already selected a particular segment. One or more switches for various tasks such as for stopping the rotatable playing surface are controlled by the microprocessor on a time sequence basis so that particular tasks must be player activated during a particular time interval or the task is automatically preformed by the microprocessor.

These and other advantages of the invention will be described with respect to the Detailed Description of the Invention.

DESCRIPTION OF THE DRAWINGS

The objects and advantages of the invention will become apparent to those skilled in the art from the following detailed description of the invention in conjunction with the accompanying drawings in which:

FIG. 8 is a top plan view of a further embodiment of the rotatable playing surface having a non circular race surrounding the rotatable playing surface and the chute and return holes in the rotatable playing surface for the return of the rotatable object;

FIG. 9 is a cross-sectional view taken along the lines 9—9 of FIG. 8;

DETAILED DESCRIPTION OF THE INVENTION

Figure 1:
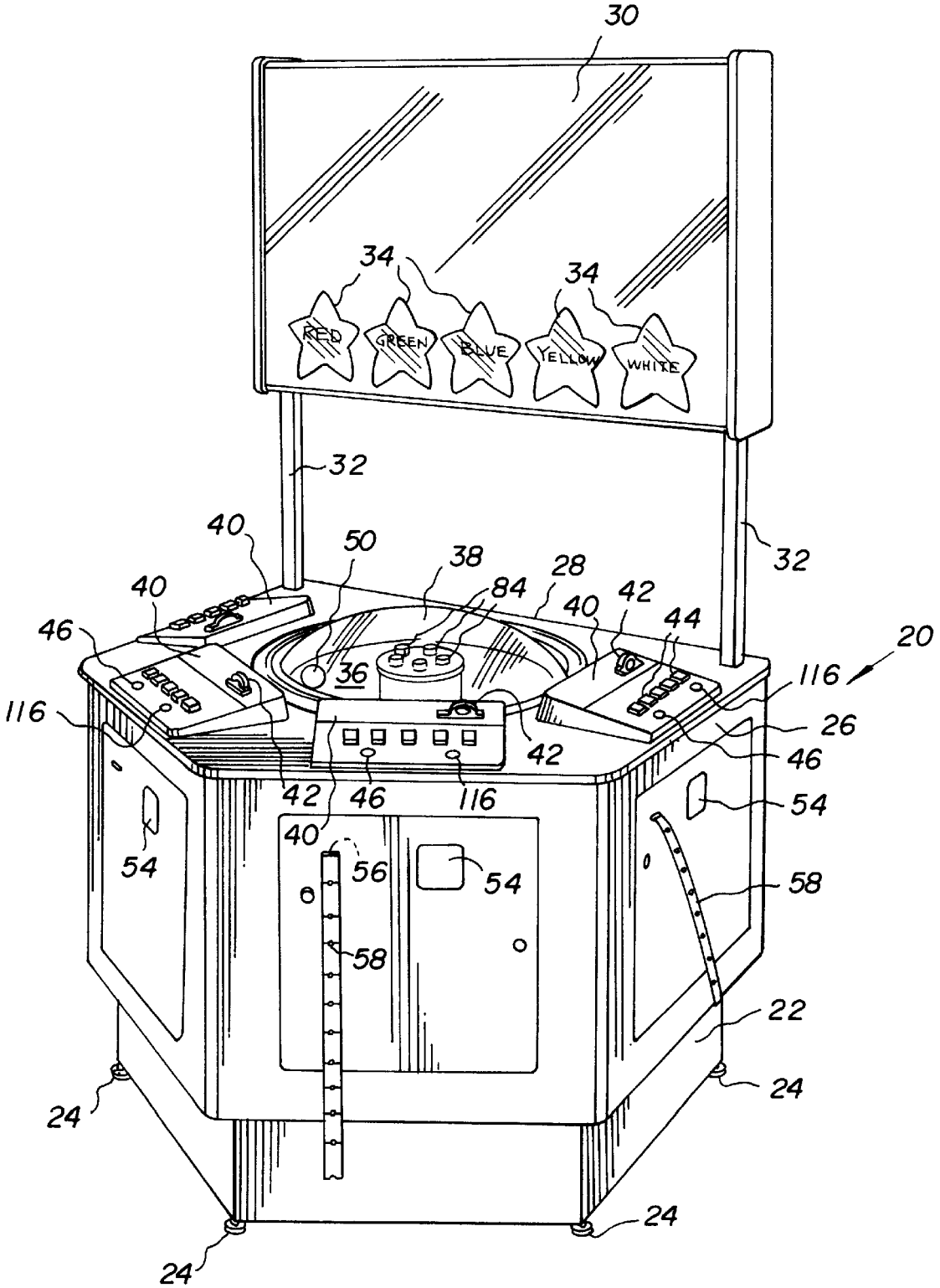
FIG. 1 is a perspective view of the novel rotatable surface playing game with housing, display and multiple player control units.

Referring now to FIG. 1 a housing 20 is illustrated having a base 22 with a levellable support 24 surrounding base 22 for levelling housing 20. Housing 20 is preferably a five-sided cabinet 26 having one long side 28 which matches the width of five-sided cabinet 26 so that two housings 20 can be placed back to back against a similarly configured housing. Housing 20 is designed to support a display 30 which is mounted to cabinet 26 by two upstands 32 which provide support and carry wiring for lighting lights in display 30. Display 30 includes five identifying indicia such as stars 34 for identifying the five segments of the rotatable playing surface 36 disposed in housing 20 under a transparent cover 38. As will be recognized identifying indicia or symbols other than stars 34 can be used to identify each of the various segments of the rotatable playing surface 36.

The five-sided cabinet 26 includes four sides of approximately equal length which provides support for a player control panel 40 for four players. Each player control panel 40 includes a coin acceptor mechanism 42 for accepting coins, tokens or other objects for starting the game. Control panel 40 includes five player input buttons 44 for selecting a particular color segment on the rotatable playing surface 36 which corresponds to each of the five color segments of the rotatable playing surface as well as one of the particular stars 34 in display 30. The microprocessor of the novel rotatable playing surface game preferably includes a time-priority feature which allows the first player, in pressing a particular input button 44, to block out any subsequent player from selecting the same segment of the rotatable player surface 36.

Each player control panel 40 also preferably includes a skill-stop button or switch 46 for stopping the rotation of rotatable playing surface 36 after rotatable playing surface 36 is rotated and a rotatable object preferably a ball 50 is accelerated into race 52 surrounding rotatable playing surface 36. Associated with each player control panel 40 is a coin return 54 and a ticket dispensing mechanism 56 for dispensing tickets 58 for players that have successfully selected the proper segment of rotatable playing surface 36 through one of the five input buttons 44 prior to the beginning of the rotatable playing surface game.

Referring now to FIGS. 1, 2, 3 and 4 the rotatable playing surface game in housing 20 includes a rotatable playing surface 36 which includes a circular race 52 which in the preferred embodiment is integral with a unitary drum 60 which forms rotatable playing surface 36. Drum 60 is rotatably mounted on shaft 62 which is rotated by pulley 64 attached to a motor and motor drive 66 for rotating drum 60. Disposed at the center of drum 60 is a tower 68 which rotates with rotatable playing surface 36.

Tower 68 includes a contact sensor 70 (FIG. 3) for each segment of the rotatable playing surface 36. The seven segments of rotatable playing surface 36 which are identified by five different indicia such as colors are defined by a plurality of ribs 72. Ribs 72 can be part of drum 60 or can be held in place by fasteners 74 on drum 60 and playing surface 36. Ribs 72 project highest above playing surface 36 adjacent to tower 68. Ribs 72 taper downwardly toward playing surface 36 while playing surface 36 tapers upwardly toward race 52. Ribs 72 are designed to propel ball 50 from tower 68 to race 52 at the start of the game and to allow ball 50 to be gradually slowed by the sloping ribs 72 before coming to rest in a particular segment. Ribs 72 are of a sufficient height and spaced from one another at an interval sufficient in relation to the diameter of ball 50 so as to prevent ball 50 from allowing force imparted to ball 50 from being dissipated by ball 50 jumping over ribs 72.

Drum 60 includes an upper plate 76 and a lower plate 78 which are connected to each other and drum 60 by fasteners 80. Tower 68 rotates with drum 60 and includes a top support plate 82 which supports a plurality of lights 84 corresponding to each of the five color identified segments 86 of rotatable playing surface 36.

In the preferred embodiment of the invention drum 60 is divided unequally into seven segments 86 which include five identifying indicia. In the best mode of the invention the five identifying indicia for each of the seven unequal segments of drum 60 are, for example, a white color indicia for the smallest segment, two red color indicia segments, a yellow color indicia segment, a blue color indicia segment and two green color indicia segments. Each of the five stars 54 containing one of the corresponding five colors on drum 60 and each of the five input buttons 44 on player control panel 40 include a corresponding color to identify each of the five color coded segments 86 on rotatable playing surface 36. It will be understood that rotatable playing surface 36 can include seven instead of five identifying indicia and that rotatable playing surface 36 can be divided into more than seven segments or less than seven segments and the segments may be equally or unequally divided.

The division of playing surface 36 into seven unequal segments with five different identifying indicia allows the player to recognize the chance of hitting a green or red segment is greater due to their proportionally greater surface area. This allows the player to utilize greater skill in activating the skill-stop button or switch 46 to stop the rotation of rotatable playing surface 36 after ball 50 has been propelled into race 52 to increase the likelihood ball 50 will come to rest in their previously selected segment. This aspect of skill plus the aspect of skill in first selecting a segment before other players by the microprocessor allowing the first player to make a selection and prevent a subsequent player from making the same selection allows players to compete against one another in the selection of segments at the beginning of the game and also block another player's selection by the activation of the skill-stop button or switch during the game.

As heretofore discussed each segment 86 includes a corresponding contact sensor 70 disposed on tower 68 for determining the resting position of ball 50. Each contact sensor 70 is connected to a slip ring assembly 88 (FIG. 2) having a plurality of wiper contact position switches 90 for determining the particular contact sensor corresponding to the particular segment in which ball 50 has come to rest. The information from contact sensor 70 and wiper contact position switch 90 is provided to a central processing unit or microprocessor 92 from a color selected sensor box 94.

Prior to the start of the novel game, information from a coin start switch box 96 is provided to the microprocessor 92 to start the game and information as to which of the five color select buttons 44 has been selected by each of the players is provided to the microprocessor 92 through color select button box 98. The information as to the particular color selected by each player is then stored in the microprocessor 92 prior to the start of the novel rotatable playing surface game. The microprocessor 92 and operational software for operating color select buttons box 98 preferably includes means for time sequencing and blocking player selection of color select buttons 44 once a particular player has previously selected a particular color.

Figure 4:
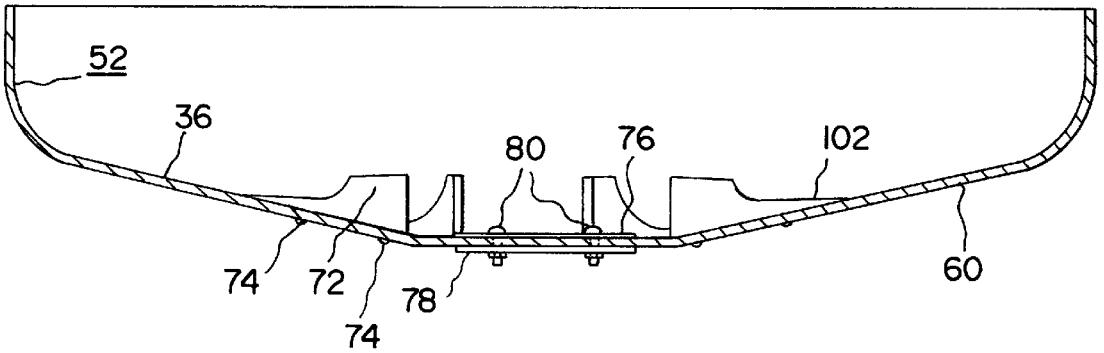
FIG. 4 is a cross-sectional view taken across the line 4—4 of FIG. 3.

The direction of rotation of rotatable playing surface 36 is in a clockwise direction as illustrated by direction of rotation arrow 100. It will be recognized that the direction of rotation utilized may be clockwise or counterclockwise to accelerate ball 50 from its rest position against one of the contact sensors 70 out onto race 52 by the utilization of ribs 72. As illustrated in FIG. 4 the general shape of drum 60 is slightly concave in cross-section with the outer edge of drum 60 being upturned to form race 52.

Ribs 72 are preferably of a tapered fin-shaped configuration so that the highest portion of rib 72 is adjacent to tower 68 from which the ribs extend outwardly and taper downwardly toward the concave configuration of drum 60. The height of rib 72 at its highest portion closest to tower 68 should be sufficient to substantially bridge the diameter of ball 50 so that rapid rotation of drum 60 results in rib 72 rapidly accelerating ball 50 into race 52. In addition the tapering of rib 72 downwardly and outwardly along the inner surface of drum 60 allows ball 50 to jump over some of the outward ends 102 of one or more of each rib 72 to add additional challenge to the novel rotatable playing surface game. This aspect of the invention adds challenge to the game in combination with the time sequence for automatically stopping the rotation of drum 60 if the rotation of drum 60 is not previously stopped by a player activating skill-stop button or switch 46. In either case ball 50 is designed to rotate in race 52 for a short period of time once drum 60 is stopped.

In the best mode of the invention motor drive 66 is designed to first rotate drum 60 rapidly to accelerate ball 50 into race 52 by the utilization of ribs 72. Once ball 50 is in race 52 motor and motor drive 66 is designed to rapidly stop the rotation of drum 60 so that ball 50 rotates in race 52 as a result of its own inertia. To rapidly stop drum 60, motor and motor drive 66 may utilize a brake or, in the best mode of the invention, electrical impulses are provided to pulse motor and motor drive 66 in a reverse direction to provide a rapid stop of drum 60 to allow ball 50 to rotate in race 52 by centrifugal force for a predetermined period of time.

Figure 5:
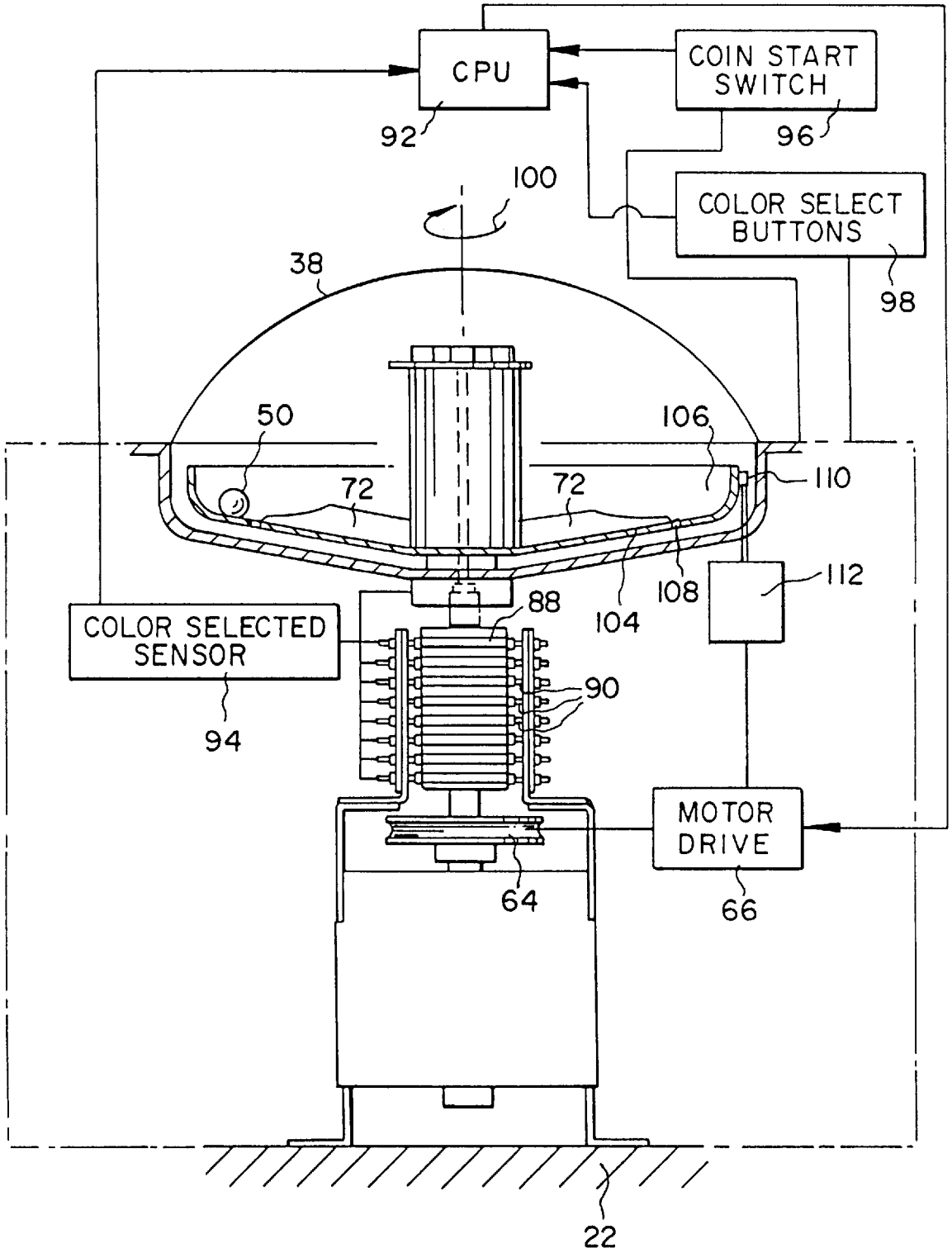
FIG. 5 is a side elevational view partly in section and partly diagrammatic illustrating a modification of the rotatable playing surface into a rotatable playing surface and a separately controlled and rotatable circular race.
Figure 6:
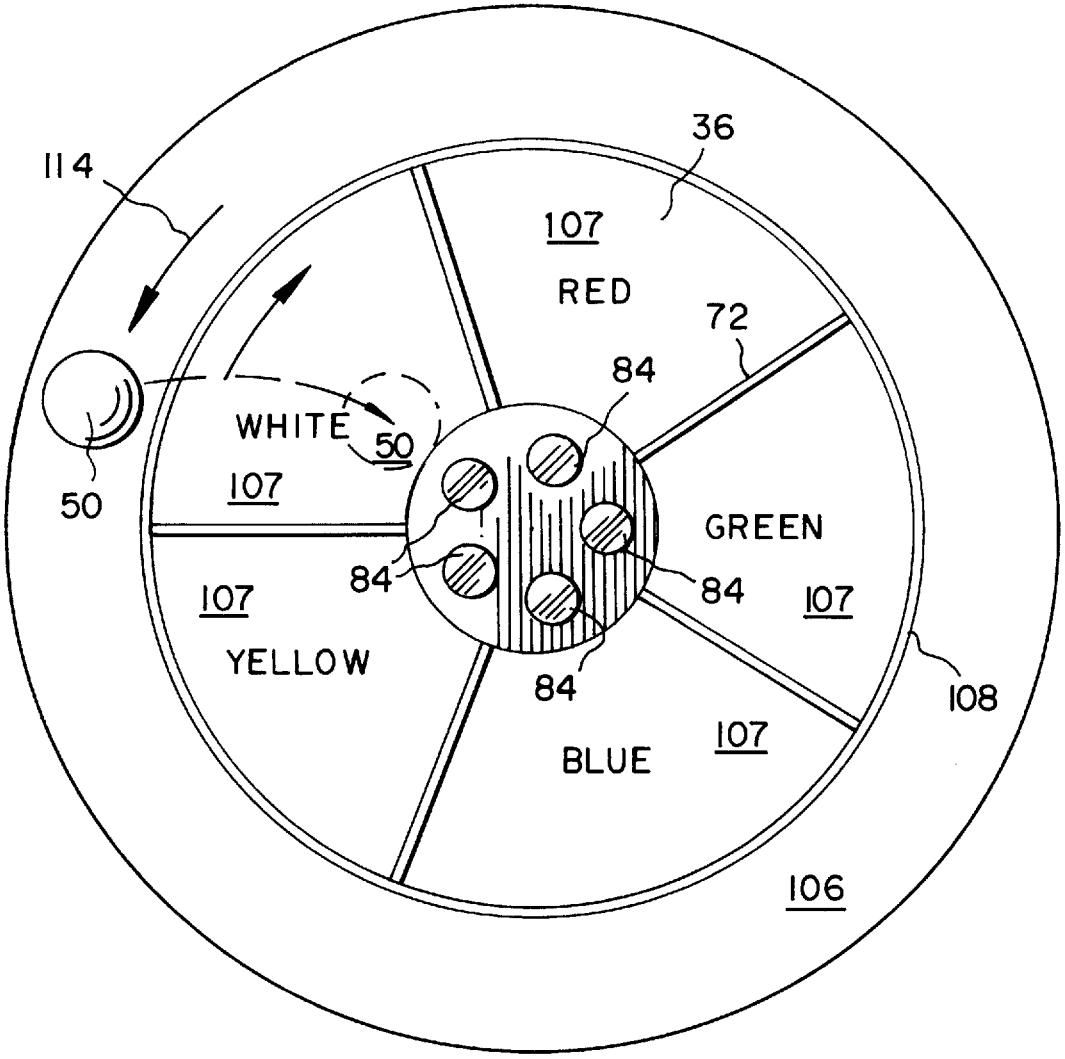
FIG. 6 is a top plan view of the rotatable playing surface of FIG. 5.

Referring now to FIGS. 5 and 6 an alternative embodiment of the invention is illustrated in which rotatable playing surface 36 has been divided into a drum 104 and a separate race 106. Drum 104 includes ribs 72 which divide drum 104 into a playing surface having five equal segments 107 represented by the colors red, white, yellow, blue and green. In this embodiment drum 104 includes a small gap or space 108 of a distance sufficient for a rotatable object or ball 50 to bridge once it is accelerated by one of the ribs 72 into race 106 and after ball 50 deaccelerates and rolls back onto rotatable playing surface 36. The race 106 circumscribes drum 104 and is itself separately rotatable with respect to drum 104 by a friction roller 110 attached to a separate motor 112 for separately rotating race 106 in a clockwise direction as represented by arrow 100 or in a counterclockwise direction as represented by arrow 114 in FIG. 6.

The rotation of race 106 in a clockwise direction delays the entry of ball 50 onto the playing surface 36 and if drum 104 is rotated in a clockwise direction it hastens the entry of ball 50 onto playing surface 36. In this manner ball 50 may be quickly slowed or not quickly slowed in race 106 by the application of power to motor 112 through motor and motor drive 66 which can be activated by a further optional control button or switch 116 (FIG. 1) to increase the complexity and level of skill required to play the novel rotatable playing surface game of the invention.

Figure 7:
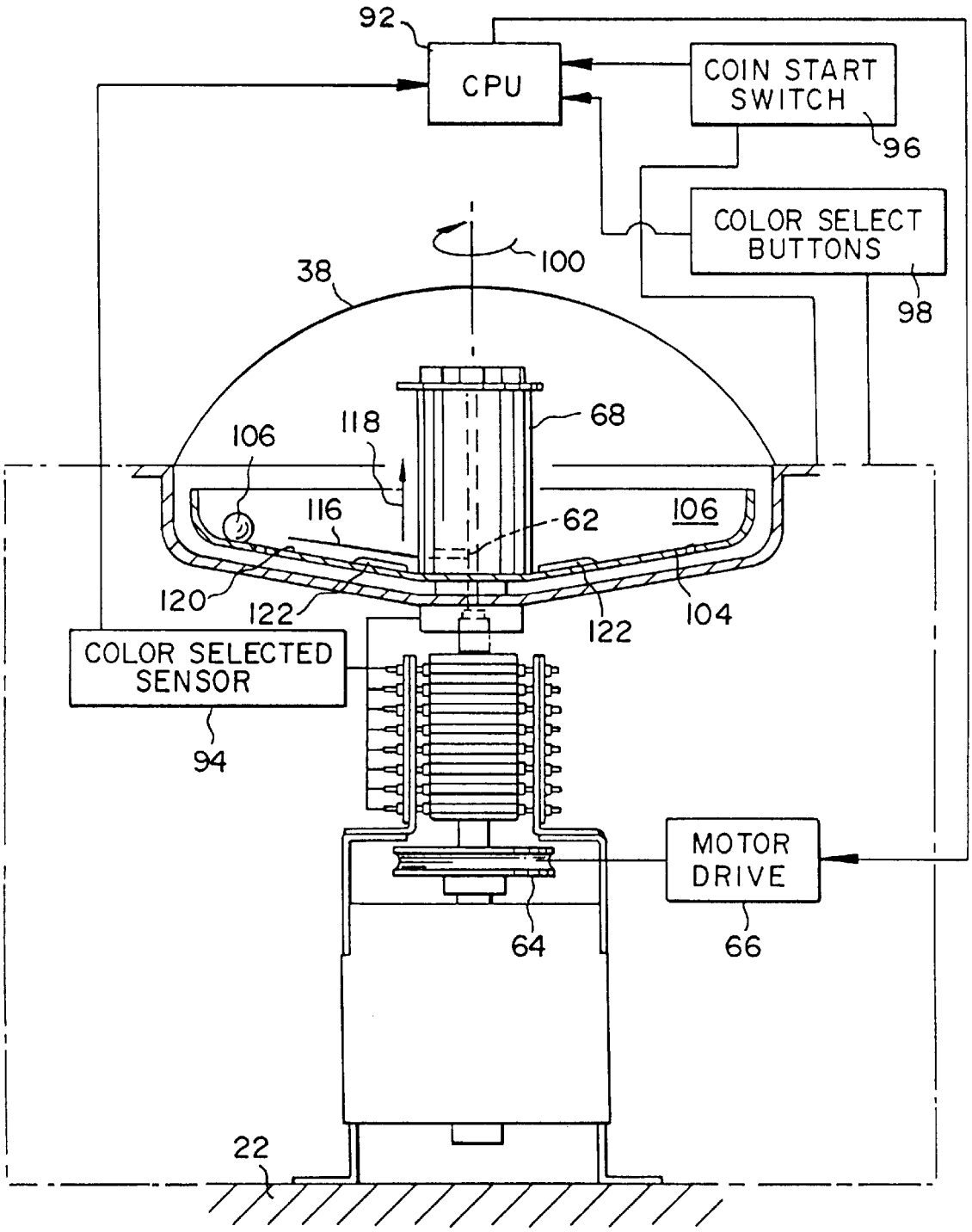
FIG. 7 is an elevational view partly in section and partly diagrammatic illustrating a further embodiment of the novel rotatable playing surface game with an acceleration arm for accelerating a rotatable object onto a separate circular race.

Referring now to FIG. 7 an alternative embodiment of the invention is illustrated wherein the means for accelerating the rotatable object or ball 50 includes a mechanical acceleration arm 116 driven by shaft 62. Mechanical acceleration arm 116 can be driven by pulley 64 which also is designed to drive drum 104, or a separate gearing, linkage or a separate high speed acceleration motor may be utilized to drive mechanical arm 116 in a rotational direction as represented by direction of rotation arrow 100. Once mechanical acceleration arm 116 accelerates ball 50 into race 106 mechanical acceleration arm 116 may be raised in the direction of arrow 118 and thereafter lowered at the completion of the game to a position which is slightly above the surface 120 of drum 104. The mechanical acceleration arm 116 may be straight or slightly curved to assist in a acceleration of ball 50 into the race surrounding rotatable playing surface 36.

Figure 2:
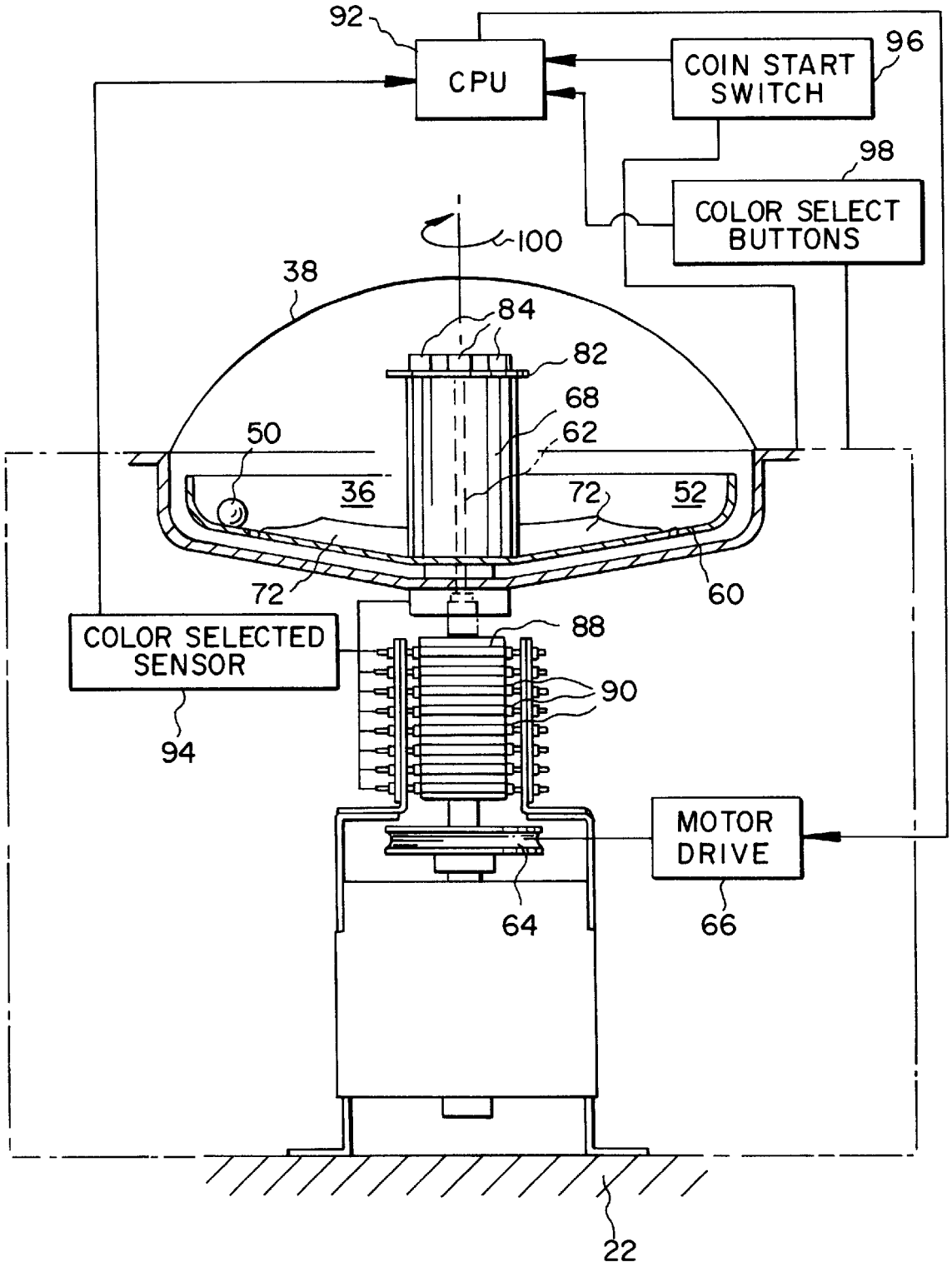
FIG. 2 is a side elevational view partly in section and partly diagrammatic illustrating the preferred embodiment of the rotatable playing surface, drive means and computer control of the novel rotatable playing surface game.
Figure 3:
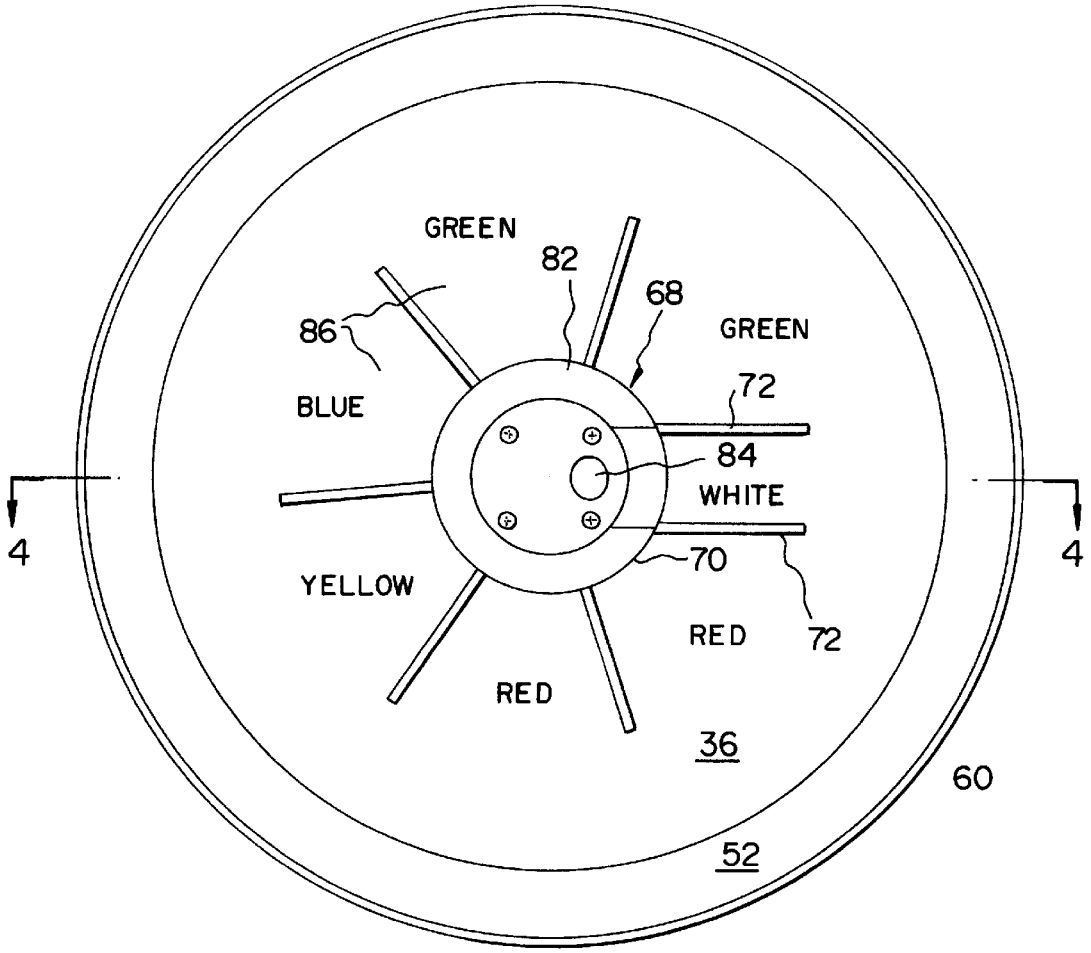
FIG. 3 is a top plan view of the rotatable playing surface divided into unequal segments in accordance with the best mode of the invention.

In various applications of the invention particularly when an acceleration means such as a mechanical acceleration arm 116 is utilized a plurality of small ribs 122 (FIG. 7) may be used instead of the ribs 72 as illustrated in FIG. 2. The small ribs 122 also serve to segment the rotatable playing surface and require higher degrees of skill of the player in determining when to stop the rotation of the rotatable playing surface and/or rotatable race as a result of the lower profile of small ribs 122.

In various other applications of the invention small ribs 122 may be utilized with various means for the acceleration of the rotatable object onto the race circumscribing the rotatable playing surface. Another such alternative embodiment for accelerating the rotatable object or ball 50 onto the race is illustrated in FIGS. 8 and 9. In FIG. 8 a rotatable playing surface 36 which may be equally or unequally segmented and which for the purposes of illustration is illustrated equally segmented into five equal segments 105 by the utilization of small ribs 122.

Rotatable playing surface 36 as illustrated in FIG. 8 may utilize color identifying segmentation for each of the segments 107 as was described with respect to FIG. 6 or other numbers, symbols or identifying indicia to identify each segment 107 of the rotatable playing surface 36. The mechanical means for accelerating ball 50 into race 106 in this embodiment of the invention is a chute 124 which may be utilized to expel ball 50 onto a non circular race 109 while rotatable playing surface 36 is rotating in the direction of rotation represented by arrow 100.

As indicated in FIG. 8 the race surrounding rotatable playing surface 36 may be of a non circular configuration. The race surrounding the circular playing surface may be oval, oblong or non linear as illustrated in FIG. 8. The race surrounding the circular playing surface may also be non planar in that it may contain hills or slopes which slow or speed up the velocity of the rotatable object as it travels in the race. Non circular configurations of the race are particularly useful in teaching or challenging skills of relative motion, speeds and distances where a chute or mechanical means for accelerating a rotatable object on the non circular race at a predetermined location within a predetermined range of velocities as can be accomplished with chute 124. Oval races and races of a linear configuration can be used with a rotatable playing surface game as described in FIGS. 5 and 6 where ribs 72 can accelerate a ball 50 with sufficient mass into a linear non circular race.

Once ball 50 is expelled onto race 109 the rotation of rotatable playing surface 36 can be stopped by the projection of circular-shaped projection through circular-shaped opening 128 in drum 104. A contact sensor 130 can be provided on each of the circular-shaped projections 126 to provide an electrical impulse to the microprocessor to indicate the position of the rotatable spherical object on rotatable playing surface 36. Once a circular-shaped projection is contacted the winner segment is identified by the microprocessor. Thereafter the game is restarted by the retraction of projections 126 from the bottom of drum 104 and ball 50 is allowed to fall through one of the return passages 132 and returned to chute 124 for restarting the game.

Figure 10A:
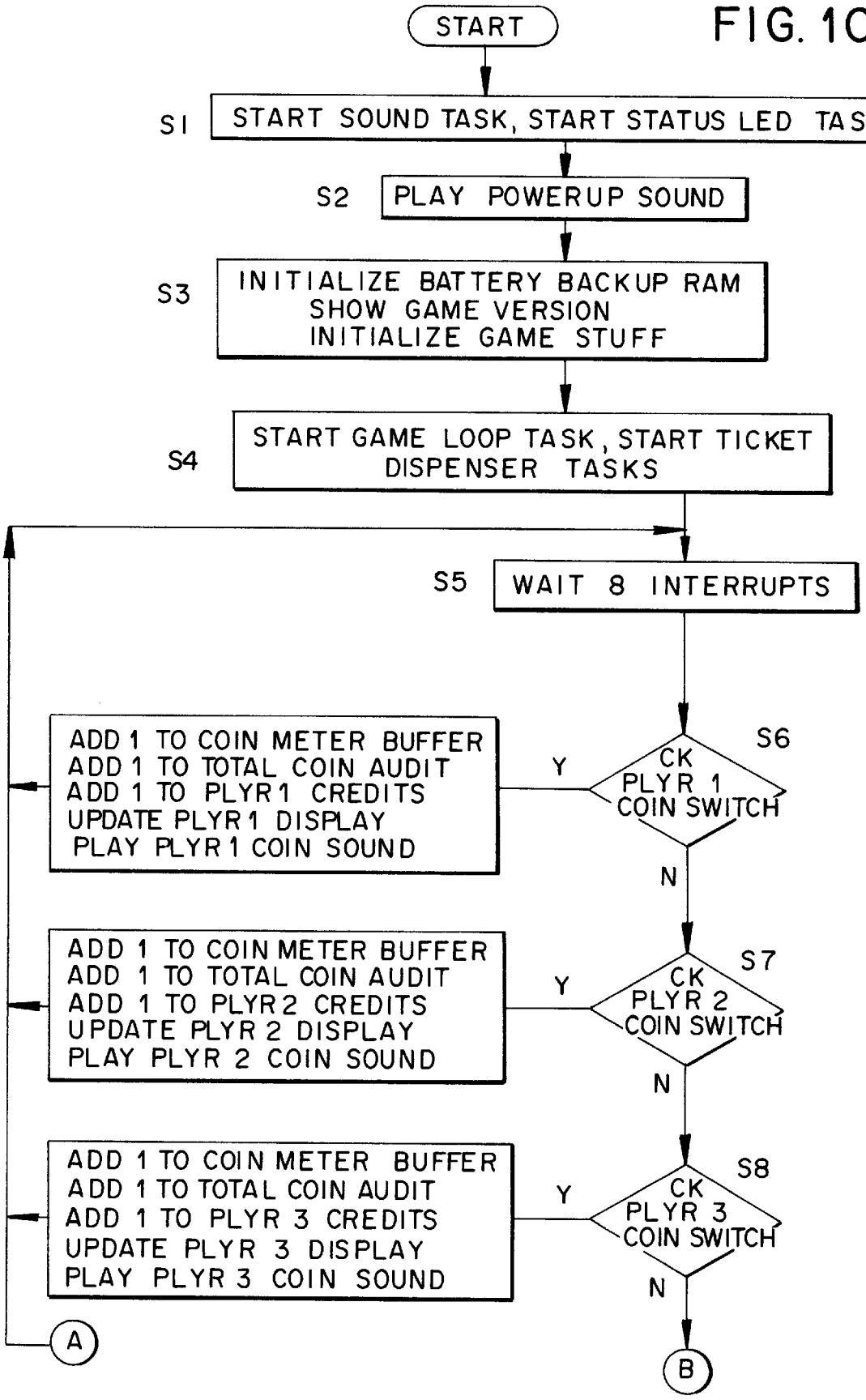
FIGS. 10A, 10B, 10C and 10D is a diagram of one embodiment of a computer program for powering up and operating the rotatable playing surface game in accordance with the invention.
Figure 10B:
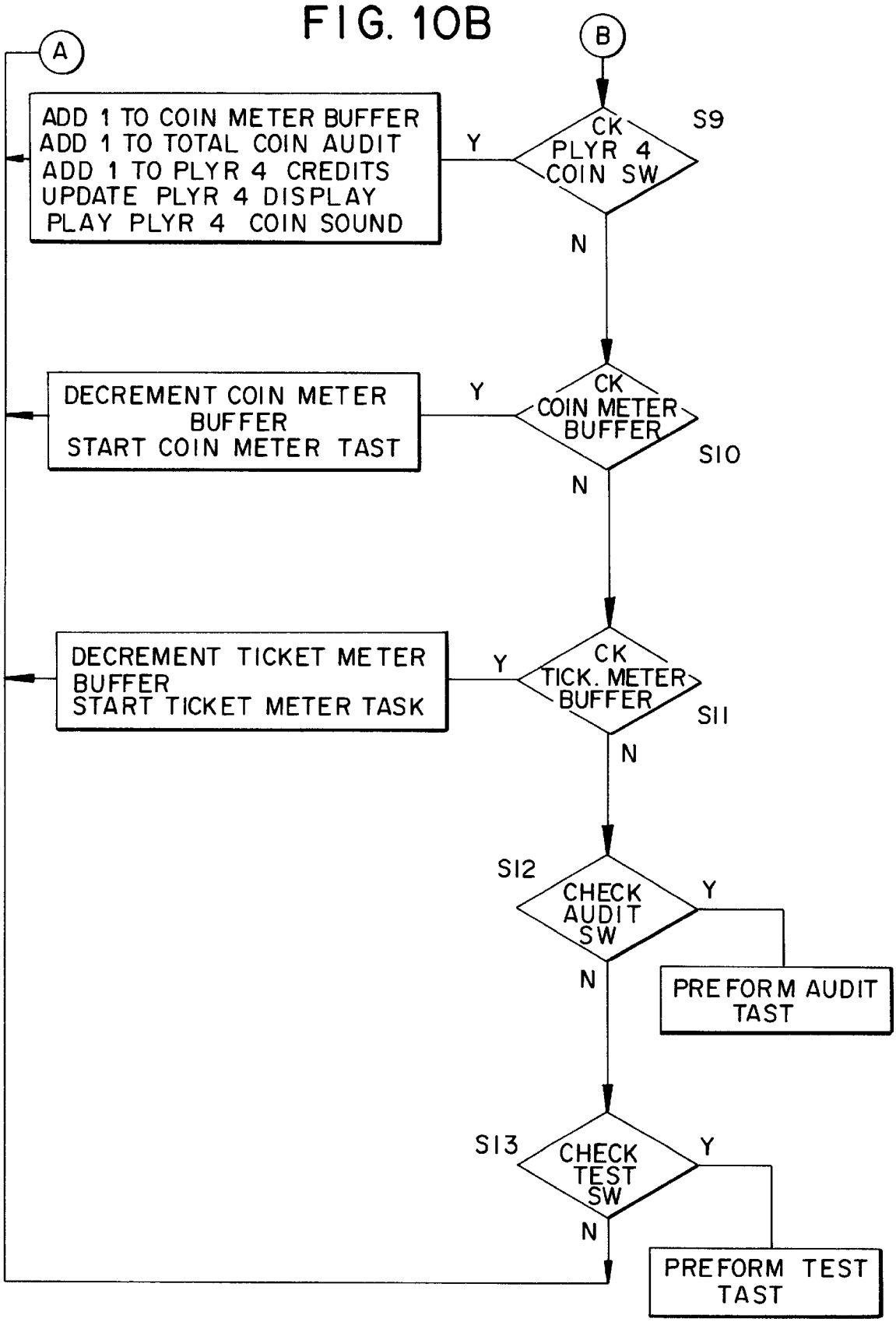
Figures 12, 12A, 12B:
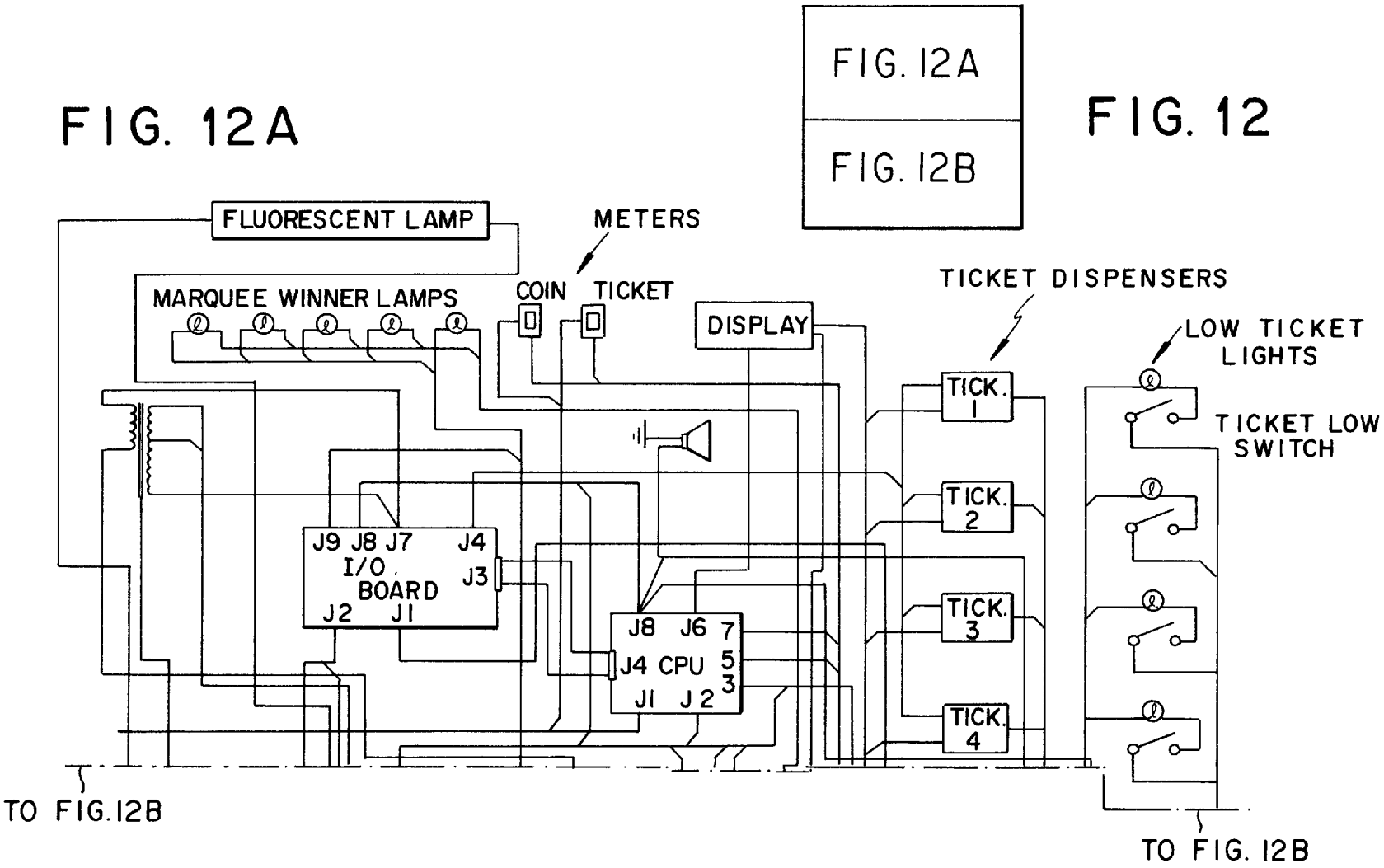
FIG. 12 is an electrical block diagram for operating the novel rotatable playing surface game in accordance with the preferred embodiment of the invention.
Figure 12B:
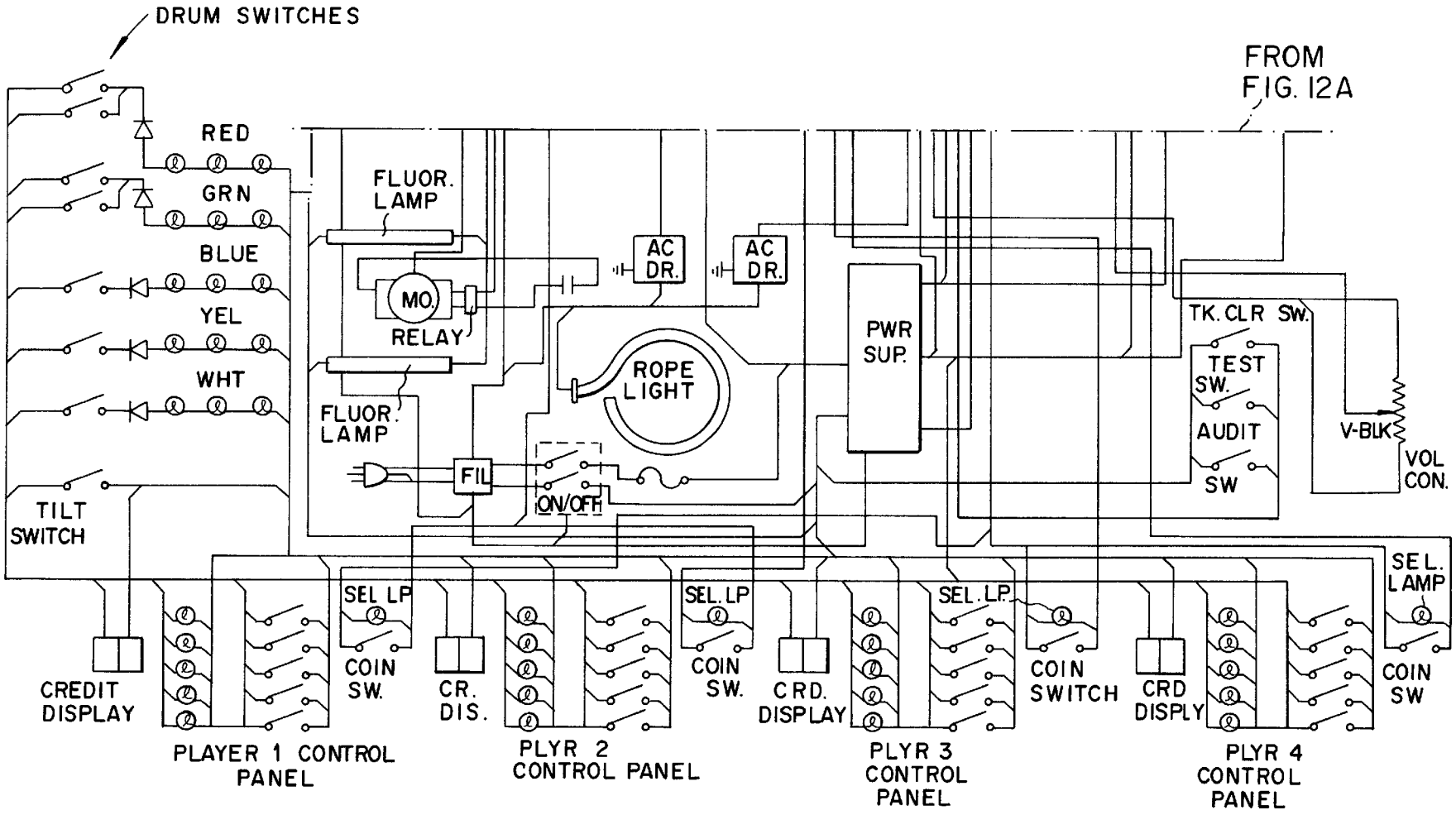

Referring now to FIGS. 2, 10A, 10B, 10C and 10D and the electrical block diagram of FIG. 12 the operation of the invention is illustrated in which microprocessor 92 includes a ROM for storing the programs of the game and a RAM for storing data derived in the course of the game. In the preferred embodiment the computer program is multitasking so that a number of the steps or tasks are provided simultaneously. The powering up and operation of the novel rotatable playing surface game and computer program for the microprocessor is illustrated in FIGS. 10A and 10B in which the game is turned on and powered which results in the start of the game sound task and the start of the LED light task at step S1. The power up sounds are provided at step S2 and the battery backup RAM is initiated at step S3 and the game loop tasks and ticket dispenser task is provided at step S4. A delay is provided at S5 before checking the four player control switches represented by S6 through S9. Thereafter self-checking by the microprocessor is completed of the coin meter buffer at S10, the ticket meter buffer at S11, the audit switch at S12 and the check test switch at S13. Appropriate audit tasks are automatically checked prior to the operation of the game by the players.

Figure 10C:
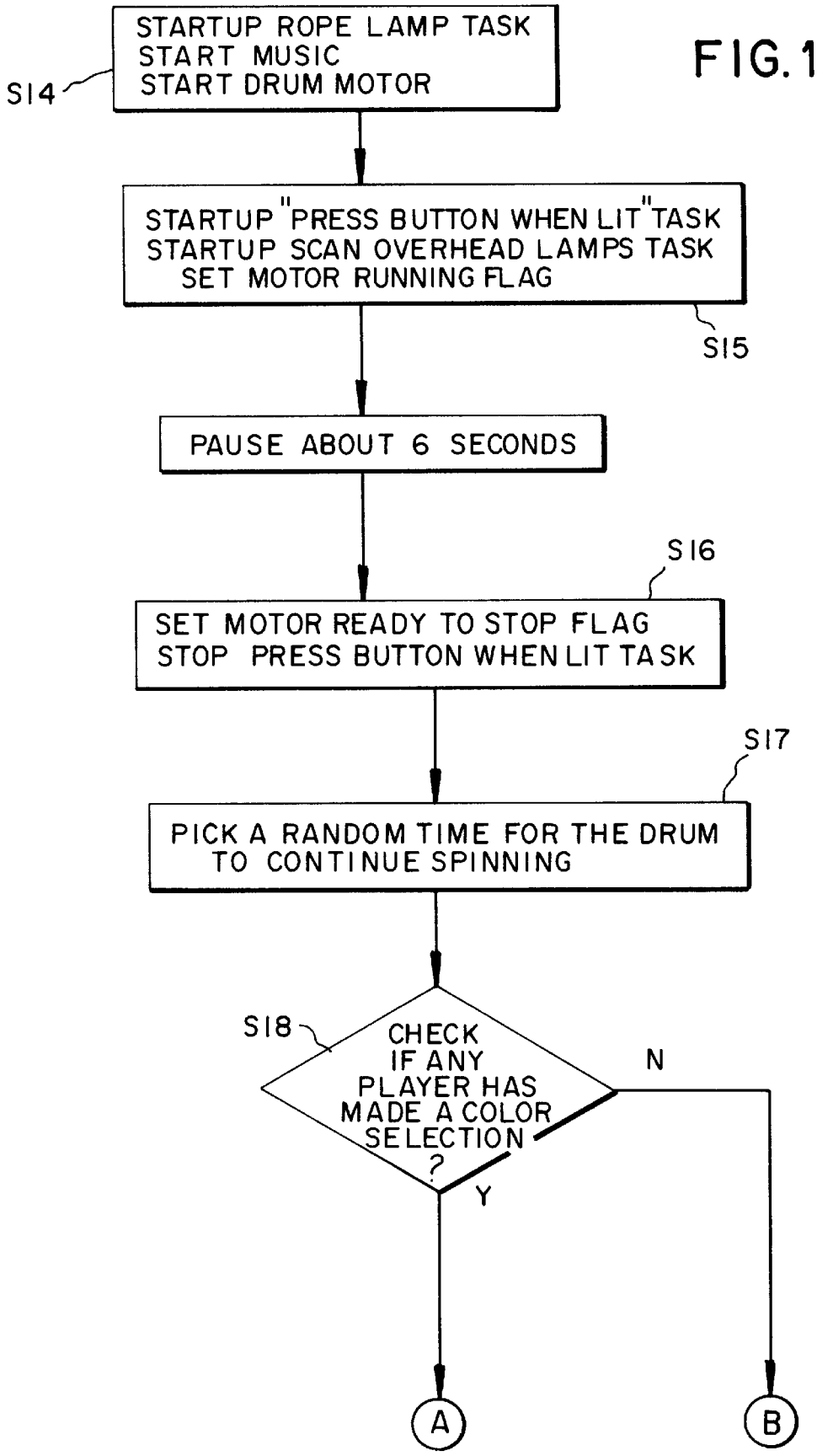
Figure 10D:
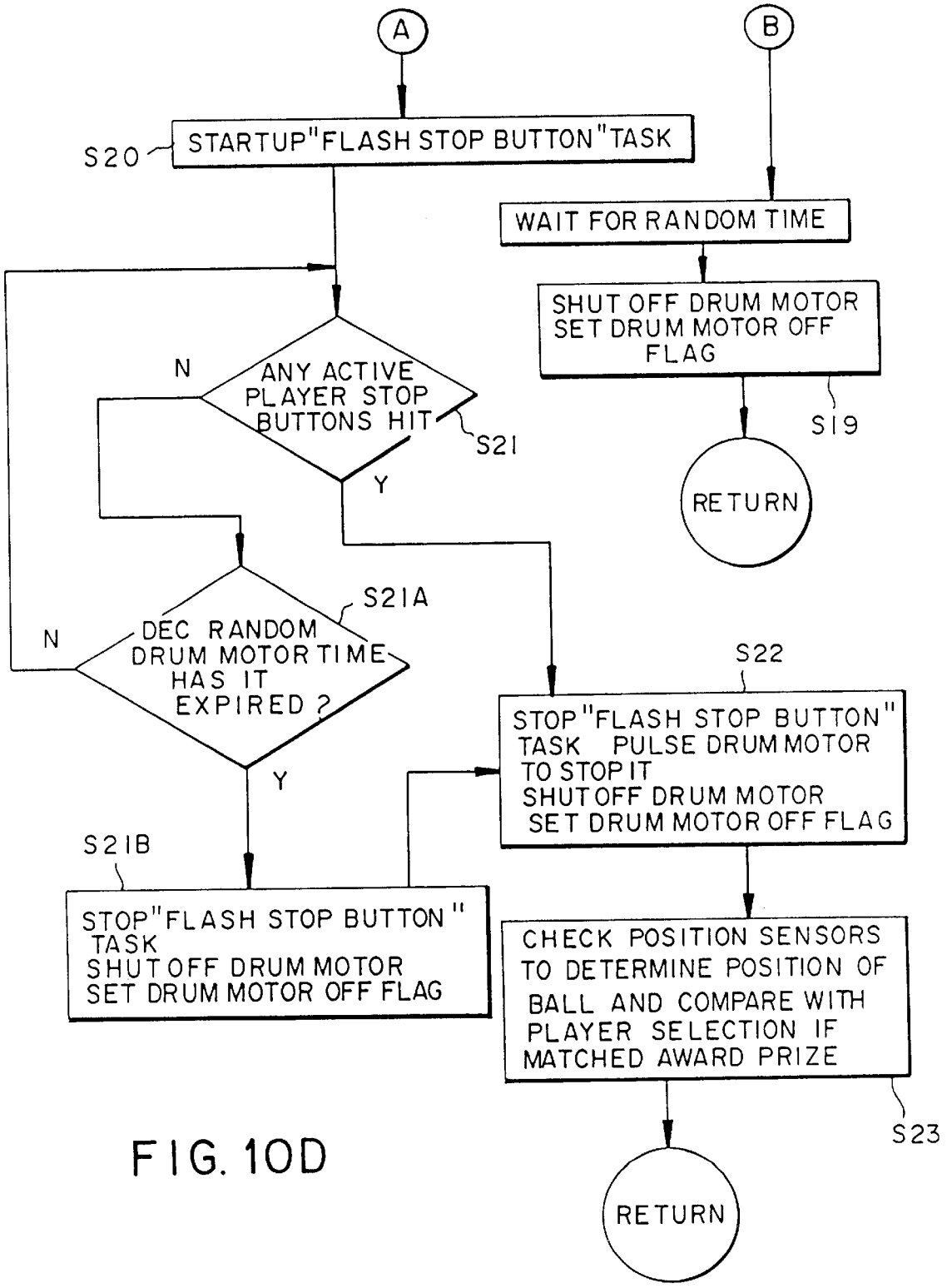

Once the power up and audit tasks have been completed the attract music and display is periodically activated. After a coin or token has been utilized to start the game the music and drum motor is activated at S14 (FIG. 10C). The five player input buttons 44 on player control panel 40 are illuminated at step S15 to allow the player to select one or more of the buttons which correspond to the various identified segments of rotatable playing surface 36 that ball 50 will come to rest after being propelled into race 52.

A pause of about 6 seconds is provided and the skill-stop button or switch 46 is illuminated at step S16 to allow the player to stop the random time selected by the computer program to continue the spinning of drum 60 at step S17. A check is then made to determine if any player has made a color selection at step S18. If a player has not made a color selection after a random period of time the drum motor is turned off at step S19 and the computer program returns the program to step S14. If a color selection was made of one of the colors corresponding to one of the segments on rotatable playing surface 36, motor and motor drive 66 is activated to rotate pulley 64 and shaft 62 to propel ball 50 into race 52 at step S20.

The flash stop button continues to remain illuminated for a period of time which is less than the maximum random time for the drum to continue spinning in step S17. If the random time has not expired the player may activate the player stop button as indicated in step S21 which then results in the stop of flash stop button along with the stopping of motor and motor drive 66 to immediately stop the rotation of shaft 62 and the rotation of drum 60 by, in the preferred embodiment, pulsing the drum motor in reverse to immediately stop the rotation of drum 60 as indicated in step S22. At this point ball 50 continues to rotate in race 52 until such time as the centrifugal force is reduced sufficiently for ball 50 to fall back into one of the segments 86 of the rotatable playing surface 36 and contact a position sensor to allow the microprocessor to determine the position of the ball in one of the segments and compare that position with a previously player selected position and, if there is a match, award a prize as indicated in step S23.

On the other hand if an active player has not hit a stop button at step S21 drum 60 continues to rotate as indicated in step S21A until the random time for the drum to continue spinning in step S17 has expired at which time the flash stop button in step S20 is turned off and the drum 60 is stopped as indicated in step S21B and drum 60 is stopped by in the preferred embodiment pulsing it in a reverse direction to immediately stop drum 60 as indicated in step S22. Ball 50 continues to travel in race 52 until centrifugal forces cause ball 50 to enter onto the now stopped rotatable playing surface 36 and contact a sensor for the microprocessor to determine the position of the ball and compare the position with a previous selection and award prizes if the player selection matches the position of the ball as indicated in step S23.

Figure 11A:
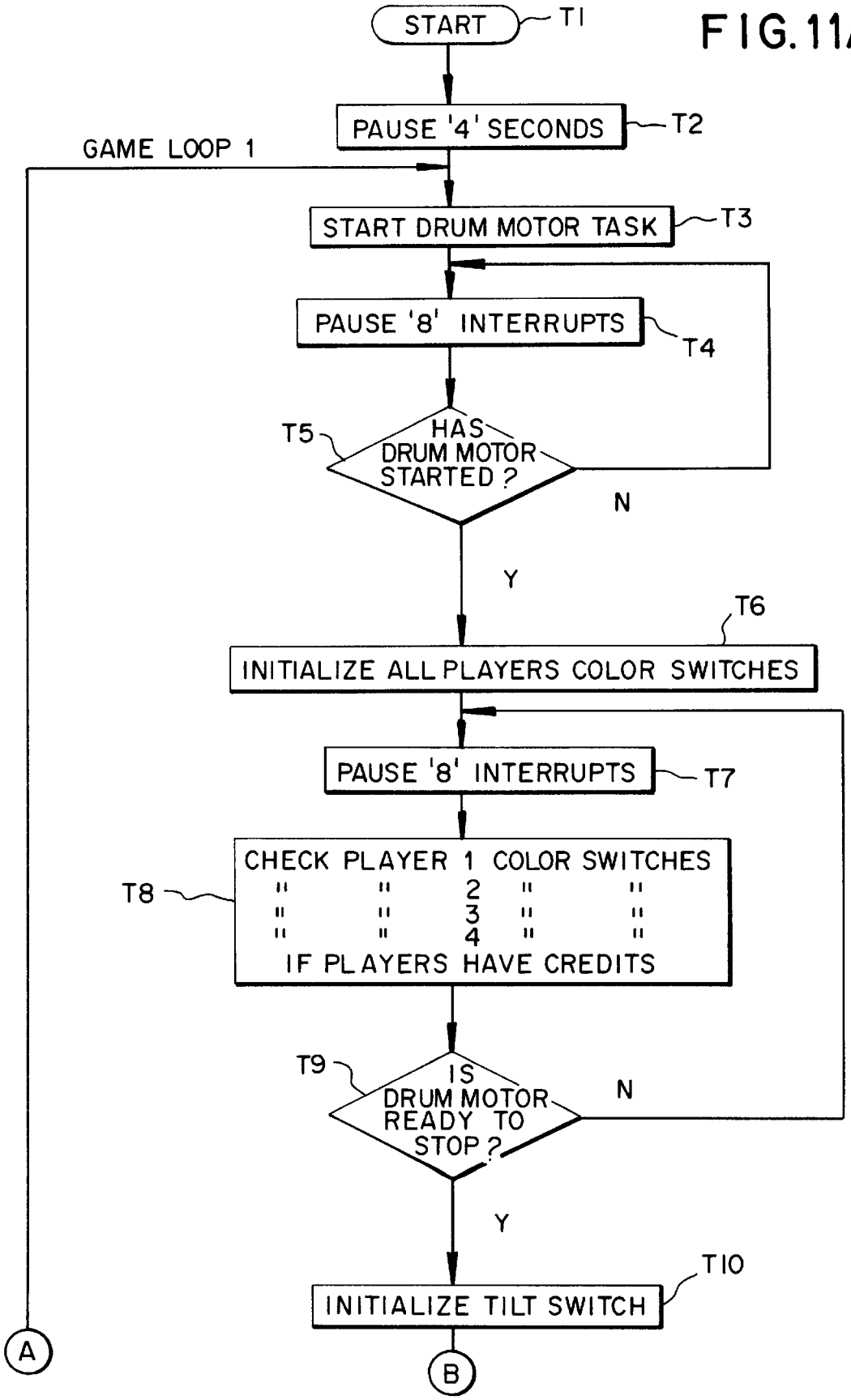
FIGS. 11A, 11B, 11C and 11D is a further diagram of a computer program for operating the rotatable playing surface game of the invention.
Figure 11B:
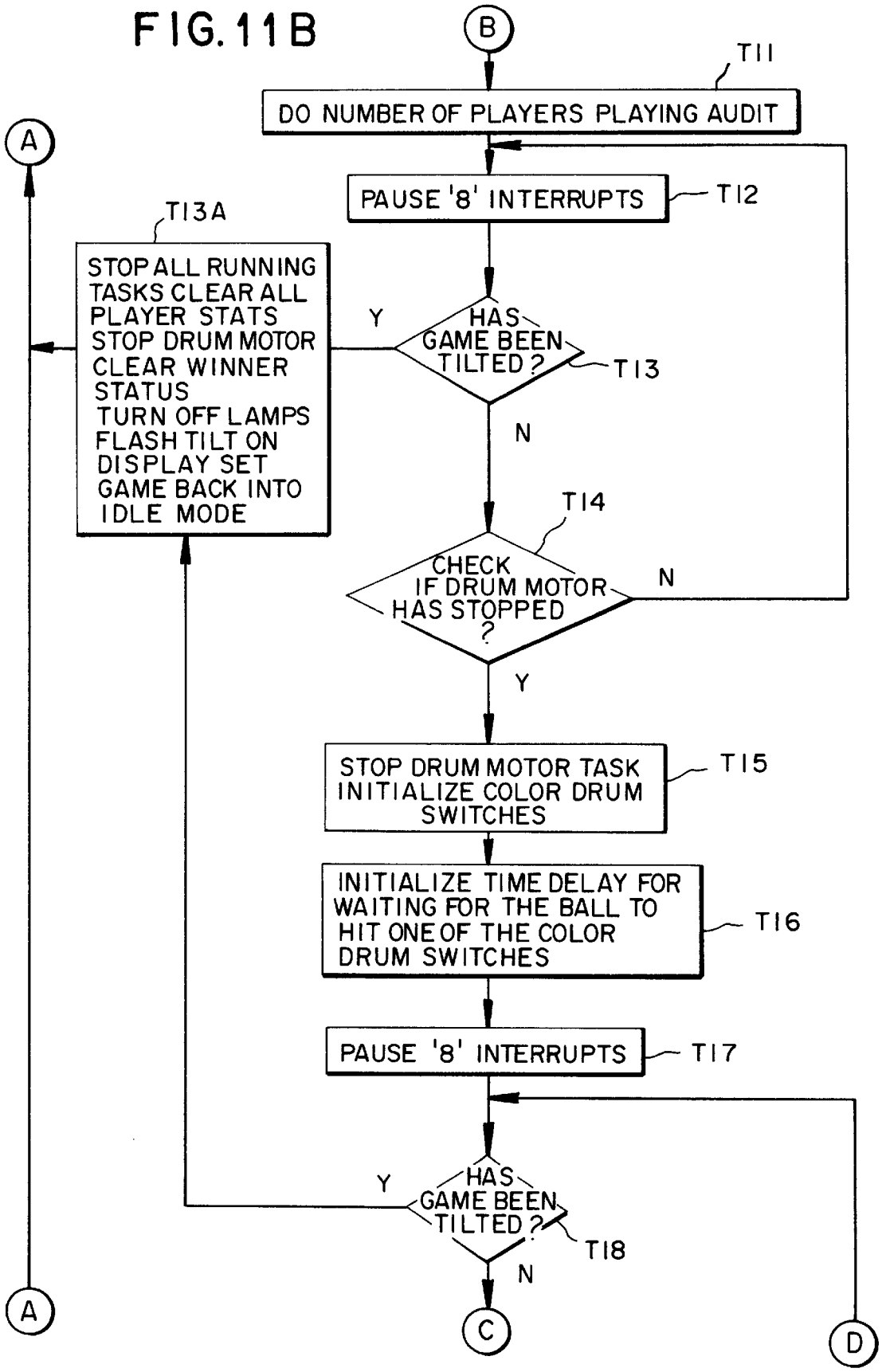
Figure 11C:
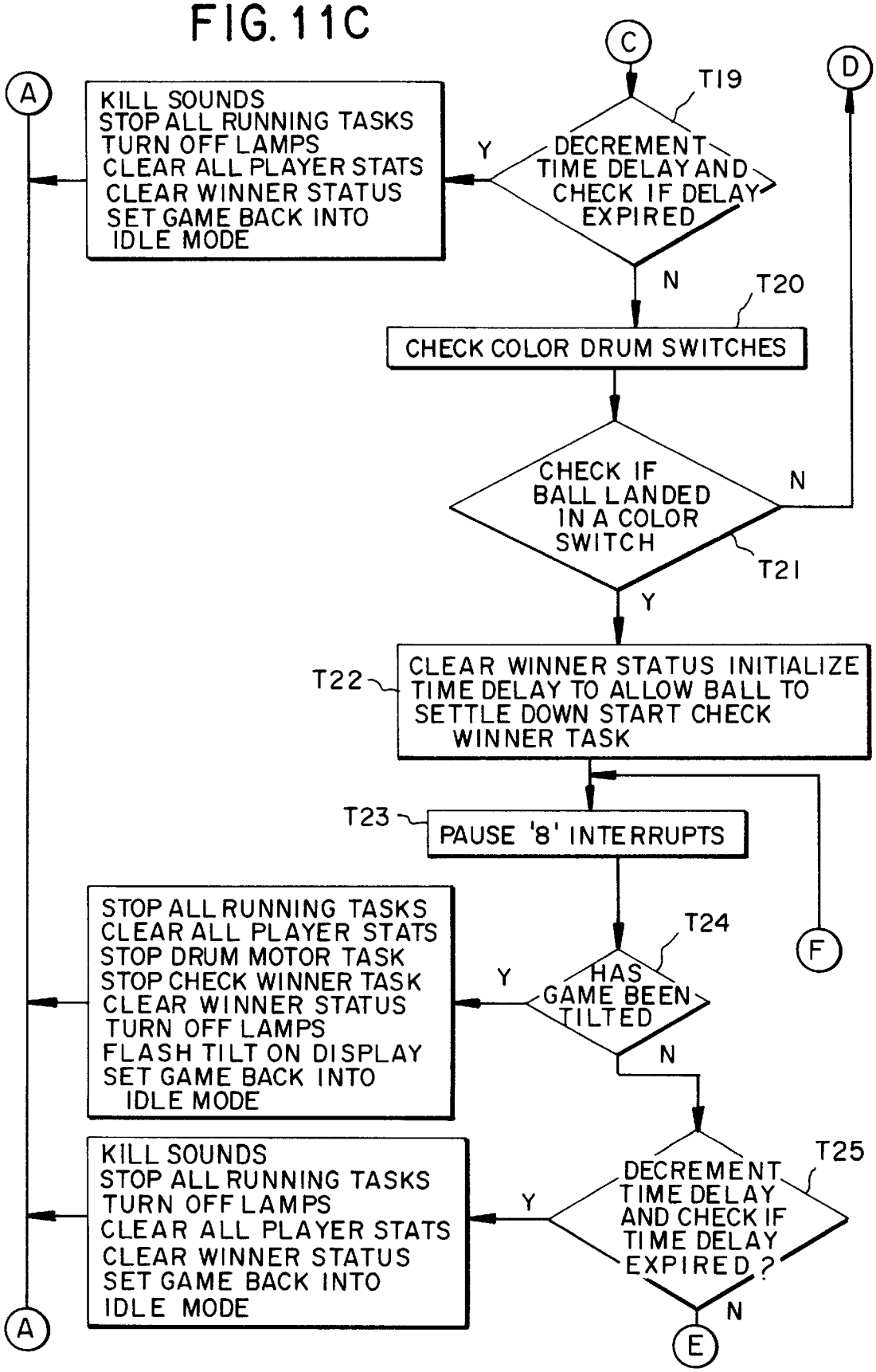
Figure 11D:
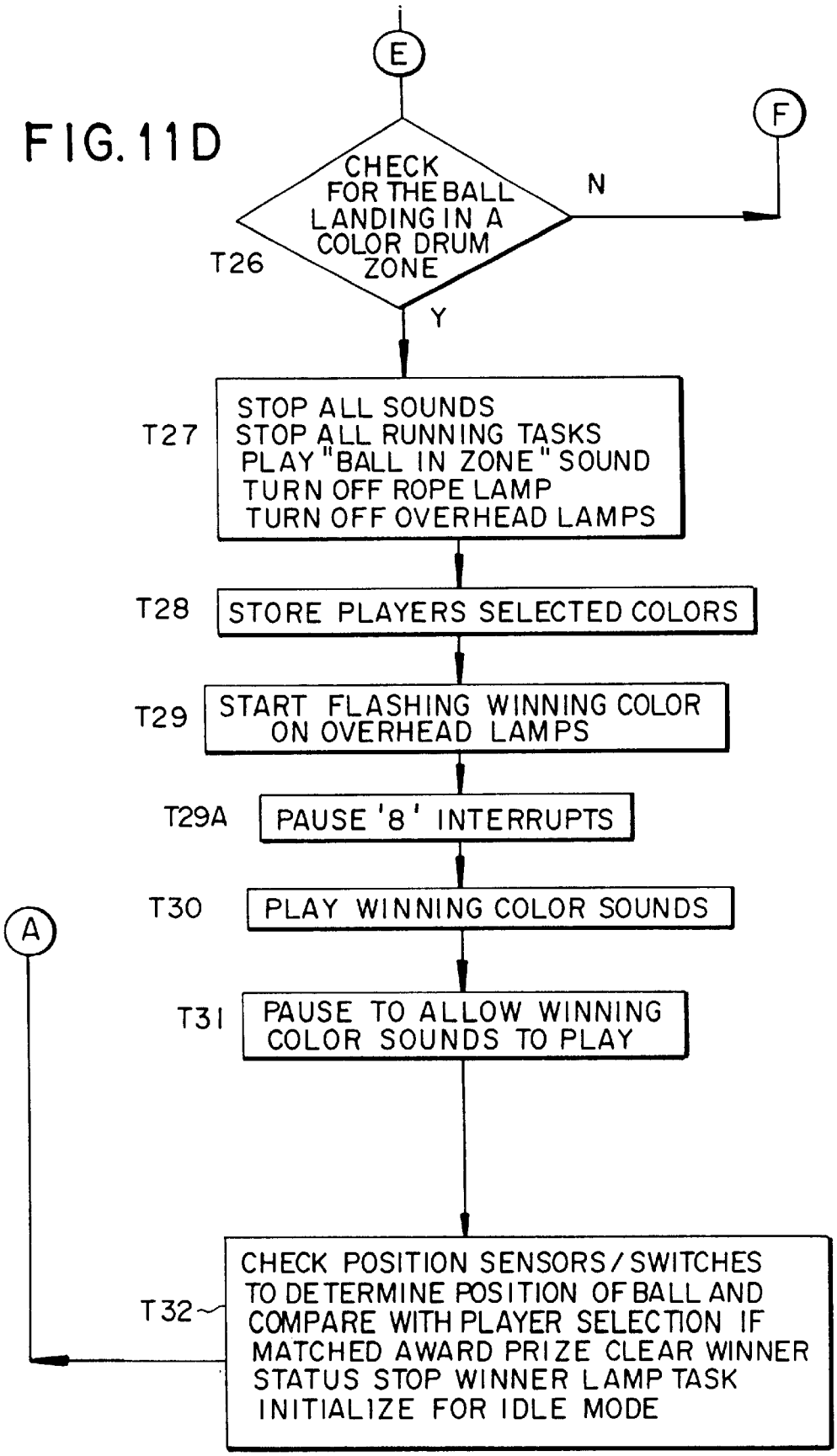

Referring now to FIGS. 11A, 11B, 11C and 11D a flow chart illustrating a multitasking computer program and timed sequence for operation of the game in accordance with the preferred embodiment of the invention is provided. After starting the novel game and running attract sounds and checking battery back-up RAM and making certain the game is properly initiated by the player inserting a coin or token as previously described the game is started at T1 as indicated in FIG. 11A with a pause of four seconds at T2 before the starting of the drum motor task at T3 which when initiated further provides a pause T4 followed by a check to make certain the drum motor has started.

After starting the drum motor all of the players' colored switches are illuminated to illuminate the five input buttons 44 to allow the players time to make a color selection at T7 of the segments of the rotatable playing surface if they have a credit obtained by supplying a coin or token as indicated by T8. Drum motor is then activated to propel ball 50 from rotatable playing surface 36 into race 52 while the rotatable playing surface continues to rotate until stopped by a player or stopped by the expiration of a random time for the continued spinning of the drum as indicated by T9. At this point a tilt-switch T10 is initiated and an audit is done of the number of players playing at T11 followed by a further interrupt at T12 before determining whether the game has been tilted at T13.

In the event the game was tilted at T13 all tasks are stopped at T13A and the game loop is returned to T2. If the game has not been tilted at T13 a check is made at T14 to determine whether drum 60 has stopped as a result of the activation of the skill-stop button or switch 46 by the player or whether the random time for the drum to continue spinning has expired. Where the period has expired or the skill-stop switch button 46 has been activated to stop the motor the color drum switches or contact sensors 70 around tower 68 are activated at T15. Once contact sensors and switches 70 have been activated a time delay T16 is provided to wait for ball 50 to loose inertial energy to move from race 52 onto the now stopped rotatable playing surface 36 for a pause period of time represented by T17.

A further check is then made to determine whether the game has been tilted at T18 before checking to see if the delay or pause for the period of time necessary for ball 50 to enter rotatable playing surface 36 from race 52 has expired as represented by T19. If the time has not expired a check is made of the contact sensors 70 and associated drum switches at T20 and a determination is made of which color or segment 86 ball 52 has landed in at T21. Once the contact switch is identified at T21 a further delay is provided to check the winner status and allow the ball to settle down and check the winner as represented by T22 and T23.

A final check is then made before awarding prizes to determine whether the game has been tilted at T24 and a further delay at T25 before confirming the ball has landed in a particular segment 86 of drum 60 as represented by T26. At that point lights and sounds are provided to indicate the ball is in a particular segment as represented by T27 and a comparison is made of the particular segment with the player's selection of segments at T28 while the flashing of winning color in the overhead lamp at T29 and an interrupt at T29A and playing of the winning color sounds are subsequently provided at T30 and T31. Thereafter an award is made of tickets or prizes to the winning player at T32.

The computer program together with the sequencing and timing of steps in the operation of the invention may be modified by those skilled in the art and additional flow charts and steps may be provided where both the rotatable playing surface 36 and race 52 rotate at different speeds and different directions as has heretofore been described. The flow charts and timing sequence further may be modified for particular applications by those skilled in the art utilizing rotatable playing surfaces of various designs and configurations segmented in equal or unequal segments. In addition the configuration of the ribs may be changed as well as the provision of surface obstacles and gates on the rotatable playing surface together with skill-stop switches not only for the rotation of rotatable playing surface but also for the rotation of a rotatable race or plurality of rotatable races surrounding the rotatable playing surface.

As heretofore discussed the identifying indicia for the equal or unequal segments of the rotatable playing surface may be changed to utilize identifying indicia other than color such as symbols, numbers or any other indicia for identifying the segments on the rotatable playing surface. In addition the geometrical configuration of the rotatable object may be other than spherical and the race surrounding the rotatable playing surface may be other than circular and flat and may, for example, be oval with various slopes. In addition, as heretofore discussed, the rotatable playing surface may be segmented equally or unequally and the rotatable playing surface game may be modified so that the tower does not rotate with the drum as has heretofore been described in the preferred embodiment of the invention.

It will also be appreciated by those skilled in the art that various means may be provided for accelerating or depositing a rotatable object on the rotatable playing surface and various modifications can be made to the software to accommodate a variety of changes to the microprocessor-controlled rotatable playing surface game. It will be appreciated that these and other modifications may be made within the scope of the invention as defined in the following claims:

What is claimed is:

1. An amusement game machine having a rotatable playing surface comprising:

(a) a housing having a transparent cover;

(b) a segmented substantially circular rotatable playing surface;

(c) a race surrounding said segmented substantially circular rotatable playing surface;

(d) a rotatable object;

(e) means for rotating said substantially circular rotatable playing surface;

(f) mechanical means for accelerating said rotatable object with sufficient energy to maintain said rotatable object in said race under centrifugal force for a predetermined period of time;

(g) means for stopping the rotation of said substantially circular playing surface while said rotatable object is in said race;

(h) a sensor for indicating position of said rotatable object on said segmented substantially circular rotatable playing surface; and (i) a microprocessor for actuating said means for rotating and said means for stopping the rotation of said substantially circular rotatable playing surface.

2. The amusement game machine of claim 1 further comprising a player control panel for selecting a segment of said segmented substantially circular rotatable playing surface.

3. The amusement game machine of claim 2 wherein said mechanical means for accelerating said rotatable object is a rib extending from said segmented substantially circular rotatable playing surface.

4. The amusement game machine of claim 3 wherein said rib is attached to said segmented substantially circular rotatable playing surface.

5. The amusement game machine of claim 4 wherein said rib is divided into a plurality of ribs corresponding to each segment of said segmented substantially circular rotatable playing surface.

6. The amusement game machine of claim 5 wherein said ribs and said segmented substantially circular rotatable playing surface are divided into seven unequally divided segments.

7. The amusement game machine of claim 6 wherein said race is of a circular configuration and rotates with said segmented substantially circular rotatable playing surface.

8. The amusement game machine of claim 6 wherein said race does not rotate with said segmented substantially circular rotatable playing surface.

9. The amusement game machine of claim 7 or 8 wherein said player control panel includes four separate player control panels.

10. The amusement game machine of claim 9 wherein each of said four separate player control panels includes a skill-stop switch to activate said means for stopping the rotation of said segmented substantially circular rotatable playing surface.

11. The amusement game machine of claim 2 wherein said mechanical means for accelerating said rotatable object is a chute for depositing said rotatable object onto said race.

12. The amusement game machine of claim 11 wherein said segmented substantially circular rotatable playing surface is divided into a plurality of segments by ribs.

13. The amusement game machine of claim 12 wherein each segment of said segmented substantially circular rotatable playing surface includes a rotatable object return opening connected to said chute.

14. The amusement game machine of claim 13 wherein said race is of a substantially circular configuration and rotates with said segmented substantially circular rotatable playing surface.

15. The amusement game machine of claim 13 wherein said race does not rotate with said segmented substantially circular rotatable playing surface.

16. The amusement game machine of claim 14 or 15 wherein each segment of said segmented substantially circular rotatable playing surface includes a retractable rotatable object stopping mechanism disposed between said rotatable object return opening and said race.

17. The amusement game machine of claim 14 or 15 wherein said sensor is disposed in each of said rotatable object return opening.

18. The amusement game machine of claim 15 wherein said race is of a non circular configuration.

19. A rotatable playing amusement apparatus comprising:

(a) a housing having a transparent cover;

(b) a substantially circular rotatable surface;

(c) a segmented substantially circular playing surface circumscribing said substantially circular rotatable surface;

(d) a rotatable non-metallic spherical object;

(e) an arm disposed on said substantially circular rotatable surface for accelerating said rotatable non-metallic spherical object on said segmented substantially circular playing surface;

(f) a sensor for indicating the position of said rotatable non-metallic spherical object; and (g) a microprocessor operatively connected to said sensor and said mechanical means for accelerating said rotatable non-metallic spherical object.

20. The rotatable playing amusement apparatus of claim 19 wherein said substantially circular rotatable surface is rotatable and said segmented substantially circular playing surface is fixed.

21. The rotatable playing amusement apparatus of claim 19 wherein said segmented substantially circular playing surface is rotatable with respect to said substantially circular rotatable surface.

22. The rotatable playing amusement apparatus of claim 19 wherein said substantially circular rotatable surface and said segmented substantially circular playing surface are rotatable together as a unit.

23. The rotatable playing amusement apparatus of claim 20 or 21 or 22 wherein said arm for accelerating said rotatable non-metallic spherical object is a rib.

24. The rotatable playing amusement apparatus of claim 20 or 21 or 22 wherein said arm forms a plurality of ribs dividing said substantially circular rotatable surface into a plurality of unequal segments.

25. The rotatable playing amusement apparatus of claim 24 further comprising multiple player control panels for selecting a segment from said plurality of unequal segments.

26. The rotatable playing amusement apparatus of claim 25 wherein each of said multiple player control panels includes a skill-stop switch to stop the rotation of said substantially circular rotatable surface.

27. The rotatable playing amusement apparatus of claim 20 or 21 or 22 wherein said arm is a plurality of ribs for accelerating said rotatable non-metallic spherical object on said segmented substantially circular playing surface.

28. The rotatable playing amusement apparatus of claim 21 wherein said substantially circular rotatable surface and said segmented substantially circular playing surface are rotatable in opposite directions of rotation.

29. The rotatable playing amusement apparatus of claim 28 wherein said substantially circular rotatable surface is segmented into a plurality of segments by ribs.

30. The rotatable playing amusement apparatus of claim 29 further comprising multiple player control panels for selecting a segment from said plurality of segments.

31. The rotatable playing amusement apparatus of claim 30 wherein each of said multiple player control panels includes a skill-stop for stopping the rotation of said substantially circular rotatable surface.

32. The rotatable playing amusement apparatus of claim 30 wherein said segmented substantially circular playing surface is rotatable and each of said multiple player control panels includes a skill-stop for stopping the rotation of said segmented substantially circular playing surface.

33. An amusement game machine having a rotatable playing surface comprising:

(a) a housing having a transparent cover;

(b) a player activated control panel disposed in said housing at a location outside said transparent cover;

(c) a rotatable concave segmented substantially circular playing surface disposed under said transparent cover;

(d) a race surrounding said rotatable concave segmented substantially circular playing surface;

(e) a hub disposed around the center of said concave segmented substantially circular playing surface;

(f) sensors disposed around the circumference of said hub corresponding to each segment of said rotatable concave segmented substantially circular playing surface;

(g) a rotatable spherical object for rotation on said rotatable concave segmented substantially circular playing surface;

(h) mechanical means for accelerating said rotatable spherical object with sufficient energy to maintain said rotatable spherical object in said race for a predetermined period of time;

(i) mechanical means for stopping said rotatable concave segmented substantially circular playing surface while said rotatable spherical object is on said race; and (j) a microprocessor for controlling the operation of said rotatable concave segmented substantially circular playing surface and said mechanical means for accelerating said rotatable spherical object onto said race in relation to inputs from said player activated control panel.

34. The amusement game machine of claim 33 wherein said race surrounding said rotatable concave segmented substantially circular playing surface is of a non circular configuration.

35. The amusement game machine of claim 33 wherein said rotatable concave segmented substantially circular playing surface terminates at its outer perimeter in an upturned outer edge to form said race.

36. The amusement game machine of claims 34 or 35 wherein said mechanical means for accelerating said rotatable spherical object is a rib disposed on said rotatable concave segmented substantially circular playing surface.

37. The amusement game machine of claims 34 or 35 wherein said rotatable concave segmented substantially circular playing surface is segmented into a plurality of unequal segments.

38. The amusement game machine of claims 34 or 35 wherein said mechanical means for accelerating said rotatable spherical object is a chute disposed above said race in combination with a plurality of rotatable spherical object return openings disposed in each segment of said rotatable concave segmented substantially circular playing surface.

39. The amusement game machine of claims 34 or 35 wherein said player activated control panel includes a skill-stop switch for stopping the rotation of said rotatable concave segmented substantially circular playing surface.

40. A rotatable surface amusement game device comprising:

(a) a housing having a transparent cover;

(b) at least two player activated control panels disposed in said housing at a location outside said transparent cover;

(c) a segmented substantially circular rotatable playing surface having its outer perimeter terminating in an upturned outer edge to form a substantially circular race;

(d) a plurality of ribs extending from the surface of said segmented substantially circular rotatable playing surface;

(e) a hub disposed around the center of said segmented substantially circular rotatable playing surface;

(f) a plurality of sensors disposed on said hub and corresponding to each segment of said segmented substantially circular rotatable playing surface;

(g) a rotatable non-metallic spherical object having a diameter substantially equal to the height of said plurality of ribs;

(h) mechanical means for rotating said segmented substantially circular rotatable playing surface; and (i) a microprocessor for storing player selected segment inputs and comparing said player selected input with a sensor input to determine the position of said rotatable non-metallic spherical object after the rotation of said segmented substantially circular rotatable playing surface.

41. The rotatable surface amusement game device of claim 40 wherein said housing has five sides.

42. The rotatable surface amusement same device of claim 41 having four player activated control panels.

43. The rotatable surface amusement game device of claim 42 wherein said segmented substantially circular rotatable playing surface is segmented into five equal segments.

44. The rotatable surface amusement game device of claim 42 wherein said segmented substantially circular rotatable playing surface is segmented into seven unequal segments some of which segments are of an equal area.

45. An amusement device comprising:

(a) a housing having a transparent cover;

(b) a substantially circular rotatable hub;

(c) a segmented substantially circular playing surface circumscribing said substantially circular rotatable hub;

(d) a rotatable non-metallic spherical object;

(e) an arm for accelerating said rotatable non-spherical object on said segmented substantially circular playing surface;

(f) means for stopping the rotation of said substantially circular rotatable hub while said rotatable non-metallic spherical object is accelerated on said segmented substantially circular playing surface; and (g) a sensor for indicating the position of said rotatable non-metallic spherical object.

46. The amusement device of claim 45 further comprising a microprocessor operatively connected to said sensor and said mechanical means for accelerating said rotatable non-metallic spherical object.

47. The amusement device of claim 46 wherein said microprocessor is operatively connected to said means for stopping the rotation of said substantially circular rotatable hub.

48. The amusement device of claim 45 further comprising a skill-stop switch operatively connected to said means for stopping the rotation of said substantially circular rotatable hub.

* * * * *